US009170531B2

(12) United States Patent
Fukao

(10) Patent No.: US 9,170,531 B2
(45) Date of Patent: Oct. 27, 2015

(54) IMAGE FORMING APPARATUS WITH A RESTRICTION DEVICE THAT CONTROLS SEPARATE DRIVE SOURCES

(71) Applicant: Takeshi Fukao, Kanagawa (JP)

(72) Inventor: Takeshi Fukao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/079,009

(22) Filed: Nov. 13, 2013

(65) Prior Publication Data

US 2014/0140726 A1 May 22, 2014

(30) Foreign Application Priority Data

Nov. 20, 2012 (JP) ..... 2012-254420
Feb. 21, 2013 (JP) ..... 2013-031782
May 30, 2013 (JP) ..... 2013-114380

(51) Int. Cl.
*G03G 15/16* (2006.01)

(52) U.S. Cl.
CPC .... *G03G 15/1615* (2013.01); *G03G 2215/0132* (2013.01); *G03G 2215/1614* (2013.01)

(58) Field of Classification Search
USPC ..... 399/121
See application file for complete search history.

(56) References Cited

U.S. PATENT DOCUMENTS

2001/0022907 A1 9/2001 Fukao et al.
2004/0013451 A1 1/2004 Fukao et al.
2006/0210307 A1 9/2006 Katoh et al.
2006/0210324 A1 9/2006 Kuma et al.
2006/0216057 A1 9/2006 Fukao
2006/0284958 A1 12/2006 Saeki et al.
2007/0098472 A1 5/2007 Saeki et al.
2007/0127947 A1 6/2007 Kuma et al.
2007/0127955 A1 6/2007 Katoh et al.
2007/0248391 A1 10/2007 Yokokawa et al.
2007/0286640 A1 12/2007 Katoh et al.
2008/0145102 A1 6/2008 Katoh et al.
2008/0175619 A1 7/2008 Katoh et al.
2009/0123181 A1* 5/2009 Ito et al. ..... 399/167
2009/0169236 A1 7/2009 Fukao et al.
2009/0279906 A1 11/2009 Kuma et al.
2009/0317104 A1 12/2009 Katoh et al.
2009/0324279 A1* 12/2009 Miyahara et al. ..... 399/101
2010/0061752 A1 3/2010 Sudo et al.
2011/0103862 A1 5/2011 Saeki et al.
2012/0020698 A1 1/2012 Fukao (Continued)

FOREIGN PATENT DOCUMENTS

JP 2002-99154 4/2002
JP 2010-019964 1/2010

*Primary Examiner* — Billy Lactaoen
*Assistant Examiner* — Arlene Heredia Ocasio
(74) *Attorney, Agent, or Firm* — Oblon, McClelland, Maier & Neustadt, L.L.P.

(57) ABSTRACT

An image forming apparatus includes a rotary shaft, a first image bearing member, a nip forming member, a moving device, and a restriction device. The first image bearing member bears a visible image on a surface thereof and is rotatable about the rotary shaft which is driven directly or indirectly. The nip forming member contacts the first image bearing member to form a transfer nip therebetween. The moving device is disposed on the rotary shaft and rotates to move the nip forming member to contact and separate from the first image bearing member. The restriction device inhibits rotation of the moving member in a state in which the nip forming member is separated from the first image bearing member by the rotation of the moving device.

23 Claims, 14 Drawing Sheets

(56) References Cited

U.S. PATENT DOCUMENTS

| | | | | |
|---|---|---|---|---|
| 2012/0045245 | A1* | 2/2012 | Sakurai et al. | 399/121 |
| 2012/0121293 | A1* | 5/2012 | Mimbu et al. | 399/121 |
| 2012/0134701 | A1* | 5/2012 | Sue | 399/71 |
| 2012/0189332 | A1 | 7/2012 | Fukao | |
| 2012/0230706 | A1* | 9/2012 | Yoshida | 399/27 |
| 2012/0237251 | A1 | 9/2012 | Matsuura et al. | |
| 2013/0051828 | A1 | 2/2013 | Yogosawa et al. | |
| 2013/0177341 | A1 | 7/2013 | Saeki et al. | |

* cited by examiner

IMAGE FORMING APPARATUS WITH A RESTRICTION DEVICE THAT CONTROLS SEPARATE DRIVE SOURCES

CROSS-REFERENCE TO RELATED APPLICATIONS

This patent application is based on and claims priority pursuant to 35 U.S.C. §119 from Japanese Patent Application Nos. 2012-254420, filed on Nov. 20, 2012, 2013-031782, filed on Feb. 21, 2013, and 2013-114380, filed on May 30, 2013 in the Japan Patent Office, which are hereby incorporated herein by reference in their entirety.

BACKGROUND

1. Technical Field

Exemplary aspects of the present invention generally relate to an image forming apparatus such as a copier, a printer, a facsimile, or a multi-functional system including a combination thereof, and more particularly, to an image forming apparatus using an intermediate transfer member.

2. Description of the Related Art

There is known an image forming apparatus equipped with an image bearing member bearing a visible image known as a toner image and a nip forming member that contacts the image bearing member to form a so-called a transfer nip therebetween. In the transfer nip, the toner image is transferred onto a recording medium. In such an image forming apparatus, in order to prevent deformation and contamination of the image bearing member and the nip forming member, the nip forming member is separated from the image bearing member in cases other than an image forming operation. The nip forming member contacts the image bearing member during the image forming operation.

For example, JP2010-019964-A proposes a moving device disposed coaxially on a rotary shaft of an image bearing member supported rotatably about the rotary shaft. The rotary shaft is rotatably driven by a first drive source, and the moving device is rotatably driven by a second drive source via a drive transmission device.

In such a configuration, parts employed in the drive transmission device have different tolerances and assembly variations. As a result, backlash or play in the direction of rotation may be generated. When a plurality of gears is employed as a drive transmission device, the gears contact at the upstream side (drive source side) in a drive transmission path and rotate. Accordingly, the moving device disposed at the end of a drive transmission path has backlash only in a forward direction in the direction of rotation.

Because the moving device and the image bearing member are disposed coaxially on the same rotary shaft, while the nip forming member and the image bearing member are separated and the rotary shaft rotates in the same direction as the direction of rotation of the moving device, the frictional force between the moving device and the rotary shaft or the rotary member supported by the rotary shaft causes the moving device to rotate by the amount of backlash. As long as a certain amount of space is secured between a transfer device and the image bearing member even after the moving device rotates by the amount of backlash, rotation of the moving device does not cause an adverse effect. However, when there is a significant amount of backlash, a sufficient amount of space may not be secured between the transfer device and the image bearing member.

In view of the above, there is thus an unsolved need for an image forming apparatus capable of preventing undesirable rotation of the moving device and hence securing reliably a space between the transfer device and the image bearing member.

SUMMARY

In view of the foregoing, in an aspect of this disclosure, there is provided an improved image forming apparatus including a rotary shaft, a first image bearing member, a nip forming member, a moving device, and a restriction device. The first image bearing member bears a visible image on a surface thereof and is rotatable about the rotary shaft which is driven directly or indirectly. The nip forming member contacts the first image bearing member to form a transfer nip therebetween. The moving device is disposed on the rotary shaft and rotates to move the nip forming member to contact and separate from the first image bearing member. The restriction device inhibits rotation of the moving member in a state in which the nip forming member is separated from the first image bearing member by the rotation of the moving device.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
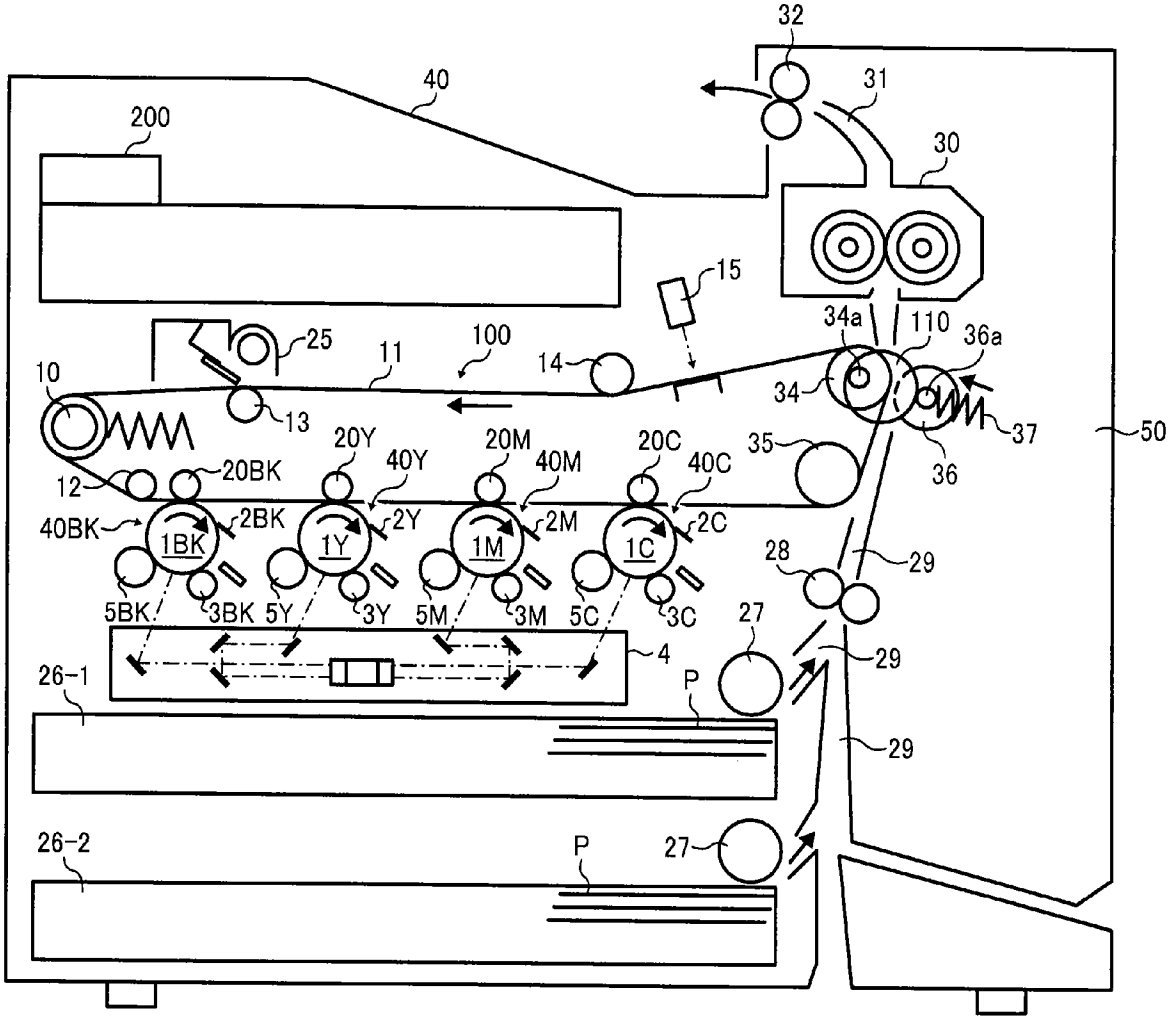
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating an electrophotographic image forming apparatus using a tandem-type indirect transfer method according to an illustrative embodiment of the present disclosure. The image forming apparatus includes a main body 50 which houses an intermediate transfer unit 100 including an intermediate transfer belt 11 as an intermediate transfer member formed into an endless loop and serving as a first image bearing member. The intermediate transfer unit 100 is disposed substantially at the center of the main body 50. The intermediate transfer unit 100 is detachably attachable relative to the main body 50.

The intermediate transfer belt 11 has a multi-layer structure including a base layer and a coating layer. The base layer is formed of, for example, a fluorine-based resin such as a relatively inelastic fluorocarbon resin and polyvinylidene fluoride (PVDF), and a polyimide-based resin. The surface of the intermediate transfer belt 11 is covered with the coating layer which is very smooth. The coating layer is formed of, for example, a fluorine-based resin.

The intermediate transfer belt 11 is entrained around a plurality of rotary members (rollers), i.e., support rollers 10, 12, 13, 14, 34, and 35, and rotatable in a counterclockwise direction indicated by an arrow in FIG. 1. The support roller 13 serves as a cleaning opposing roller. The support rollers 10, 12, 14, and 35 serve as tension rollers. The support roller 34 serves as a secondary-transfer opposing roller and is hereinafter referred to as secondary-transfer opposing roller.

A belt cleaning device 25 is disposed above the support roller 13 to remove residual toner remaining on the intermediate transfer belt 11 after a secondary transfer process.

Four image forming units 40BK, 40Y, 40M, and 40C corresponding to each of the colors black, yellow, magenta, and cyan, respectively, are disposed substantially below the intermediate transfer belt 11 stretched taut between the support roller 12 and the support roller 35 along the direction of movement of the intermediate transfer belt 11. In other words, these four image forming units 40BK, 40Y, 40M, and 40C are arranged in tandem in the direction of movement of the intermediate transfer belt 11, thereby constituting a tandem image forming station.

It is to be noted that the suffixes BK, Y, M, and C denote colors black, yellow, magenta, and cyan, respectively. To simplify the description, these suffixes BK, Y, M, and C indicating colors are omitted herein, unless discrimination of colors is needed.

The image forming units 40BK, 40Y, 40M, and 40C include respective drum-shaped photosensitive members (hereinafter referred to simply as photosensitive drums) 1BK, 1Y, 1M, and 1C, each serving as a second image bearing member, charging devices 3BK, 3Y, 3M, and 3C, developing devices 5BK, 5Y, 5M, and 5C, cleaning devices 2BK, 2Y, 2M, and 2C, and so forth. The charging devices 3BK, 3Y, 3M, and 3C may employ known charging devices. An exposure unit 4 is disposed below the tandem image forming section. The exposure unit 4 projects laser light corresponding to each color against the surface of photosensitive drums 1BK, 1Y, 1M, and 1C.

The surface of the photosensitive drums 1BK, 1Y, 1M, and 1C is charged by the charging devices 3BK, 3Y, 3M, and 3C, and is illuminated with exposure light projected from the exposure unit 4, thereby forming an electrostatic latent image on the surface of each of the photosensitive drums 1BK, 1Y, 1M, and 1C. The developing devices 5BK, 5Y, 5M, and 5C develop the toner image formed on each of the photosensitive drums 1BK, 1Y, 1M, and 1C into a visible image known as a toner image associated with each color.

The photosensitive drums 1BK, 1Y, 1M, and 1C are contactably disposed facing the outer circumferential surface of the intermediate transfer belt 11. Primary transfer rollers 20BK, 20Y, 20M, and 20C serving as primary transfer devices are disposed inside the looped intermediate transfer belt 11, facing the photosensitive drums 1BK, 1Y, 1M, and 1C. The intermediate transfer belt 11 is pressed against the photosensitive drums 1BK, 1Y, 1M, and 1C, 1 by the primary transfer rollers 20BK, 20Y, 20M, and 20C, forming primary transfer nips N1 between the intermediate transfer belt 11 and the primary transfer rollers 20BK, 20Y, 20M, and 20C. A power source supplies a primary transfer bias to the primary transfer rollers 20BK, 20Y, 20M, and 20C, thereby forming a transfer electric field in the primary transfer nips N2.

A secondary transfer roller 36, serving as a nip forming member is disposed opposite the support roller 34 via the intermediate transfer belt 11 and contacts the intermediate transfer belt 11, thereby forming a so-called secondary transfer nip (transfer nip) N2. The secondary transfer roller 36 is pressed against the support roller 34 via the intermediate transfer belt 11 by a biasing member, i.e., a spring 37. A power source supplies a secondary transfer bias to the secondary transfer roller 36 or to the support roller 34, thereby forming a transfer electric field in the secondary transfer nip N2.

As illustrated in FIG. 1, a sheet feeding unit including sheet cassettes 26-1 and 26-2 storing a stack of recording media P is disposed below the exposure unit 4. A sheet of recording medium P is fed from each of the sheet cassettes 26-1 and 26-2 to a sheet path 29 by a sheet feed roller 27. The sheet path 29 is formed between the sheet feeding unit and the secondary transfer nip N2. A pair of registration rollers 28 is disposed in the sheet path 29. The recording medium P fed from the respective sheet cassette 26-1 or 26-2 is fed to the pair of registration rollers 28. The recording medium P is stopped temporarily by the pair of registration rollers 28, and skew is corrected by the pair of registration rollers 28. The recording medium P is sent to the sheet path 29 by the pair of registration rollers 28 at appropriate timing. According to the present illustrative embodiment, the pair of registration rollers 28 corrects the skew. However, correction of the skew may not be performed by the pair of registration rollers 28.

In such an image forming apparatus, when a start button is pressed, the power of the image forming apparatus is turned on. Subsequently, the entire image forming apparatus is activated, and image formation (image forming operation) in accordance with an image of an original document is performed. As will be described later, the support roller 34 is rotated by a drive motor 101 (illustrated in FIG. 3), thereby rotating the intermediate transfer belt 11 in the counterclockwise direction.

Still referring to FIG. 1, a description is provided of production of a color image. In the color image formation, the photosensitive drums 1BK, 1Y, 1M, and 1C of the image forming units 40BK, 40Y, 40M, and 40C are rotated, and single-color toner images of black, yellow, magenta, and cyan are formed on the respective photosensitive drums 1BK, 1Y, 1M, and 1C. As the intermediate transfer belt 11 is rotated in the counterclockwise direction, the single-color toner images are transferred onto the intermediate transfer belt 11 in the primary transfer nip N1 such that they are superimposed one atop the other, thereby forming a composite color image on the intermediate transfer belt 11.

While the image formation is performed by the image forming section of the image forming apparatus, the sheet feed roller 27 of one of the sheet cassettes 26-1 and 26-2 is rotated selectively to feed a recording medium P either from the sheet cassette 26-1 or from the sheet cassette 26-2. The recording medium P is fed to the sheet path, one sheet at a time by a separation roller, and then delivered to the pair of registration rollers 28. The recording medium P delivered to the pair of registration rollers 28 is sent to the secondary transfer nip N2 in appropriate timing such that the recording medium P is aligned with the composite color toner image formed on the intermediate transfer belt 11. Subsequently, the composite color toner image on the intermediate transfer belt 11 is transferred onto the recording medium P due to the transfer electric field formed in the secondary transfer nip N2.

After the composite toner image is transferred onto the recording medium P, the recording medium P is transported to a fixing device 30 disposed downstream from the secondary transfer nip N2 in the transport direction of the sheet. In the fixing device 30, heat and pressure are applied to the composite toner image on the recording medium P so as to fix the toner image on the recording medium P. After the toner image is fixed to the recording medium P, the recording medium P is output by a pair of sheet output rollers 32 onto a sheet output tray 40 outside the image forming apparatus via a sheet output path 31.

After the secondary transfer, residual toner remaining on the intermediate transfer belt 11 is cleaned by a cleaning device 25 to remove residual toner remaining on the intermediate transfer belt 11 in preparation for the subsequent imaging cycle.

The secondary transfer roller 36 contacts and separates from the intermediate transfer belt 11. Normally, the spring 37 causes the secondary transfer roller 36 to pressingly contact the intermediate transfer belt 11. However, the secondary transfer roller 36 is configured to separate from the intermediate transfer belt 11 in order to prevent contamination of the intermediate transfer belt 11 when forming a toner density adjustment pattern on the intermediate transfer belt 11, or to prevent deformation of the intermediate transfer belt 11 when the secondary transfer roller 36 remains contacting the intermediate transfer belt 11 for an extended period of time.

Still referring to FIG. 1, the image forming apparatus includes a moving device, that is, a moving cam 110, to separate the secondary transfer roller 36 and the intermediate transfer belt 11 from each other and move towards each other.

The moving cam 110 is made of resin. The moving cam 110 is an eccentric cam and disposed at both ends of a metal rotary shaft 34*a* that supports the support roller 34. Each moving cam 110 and the support roller 34 are driven to rotate individually by independent drive sources. When each moving cam 110 rotates and its top dead center is positioned at the secondary transfer roller side, each moving cam 110 contacts both ends of a shaft 36*a* that rotatably supports the secondary transfer roller 36. Accordingly, the secondary transfer roller 36 is held spaced apart from the intermediate transfer belt 11 against the biasing force of the spring 37.

Embodiment 1

Figure 3:
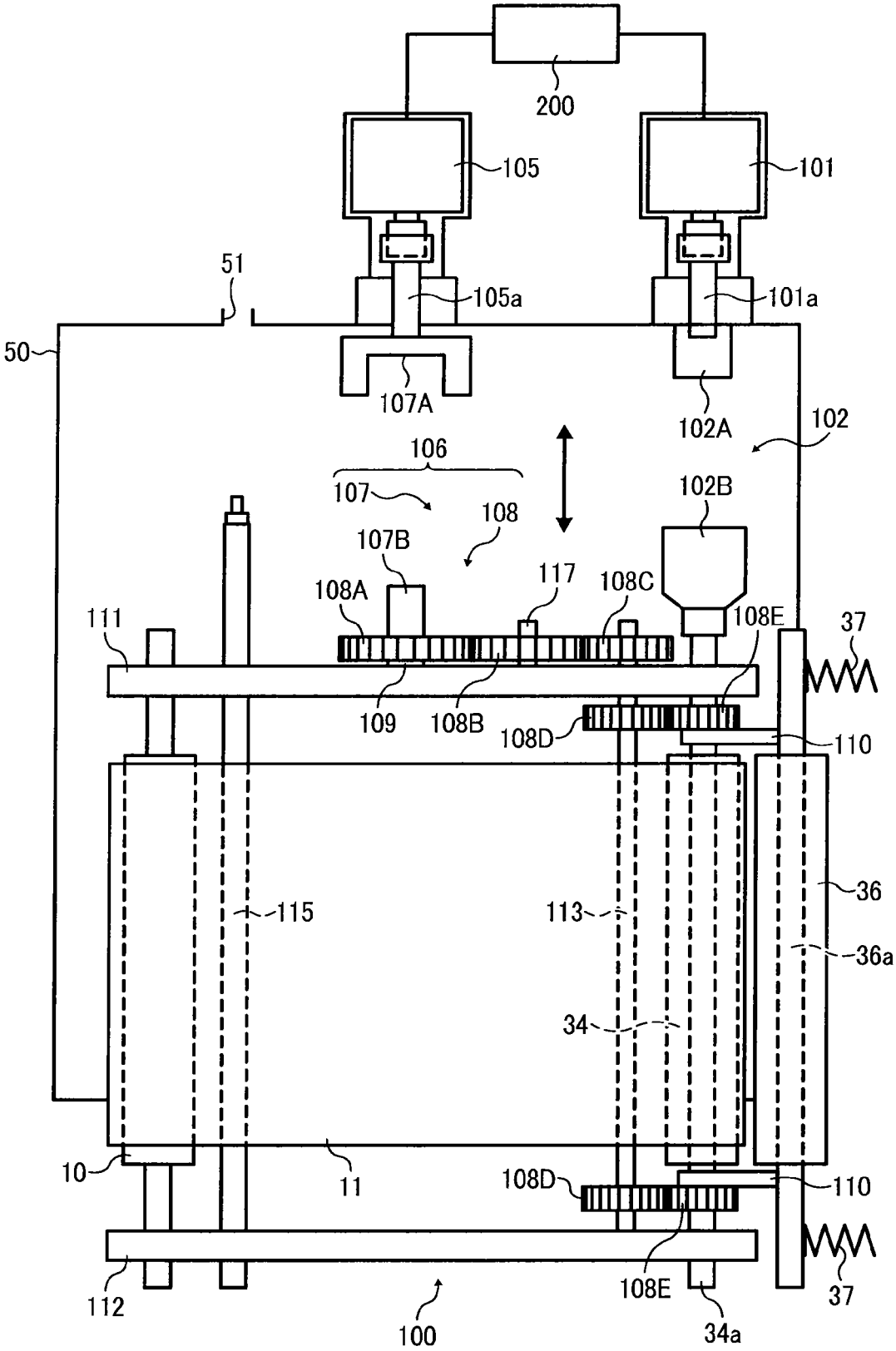
FIG. 3 is a schematic diagram illustrating drive systems and the intermediate transfer unit in a state in which the intermediate transfer unit is removed from a main body of the image forming apparatus according to a first illustrative embodiment of the present disclosure.
Figure 4:
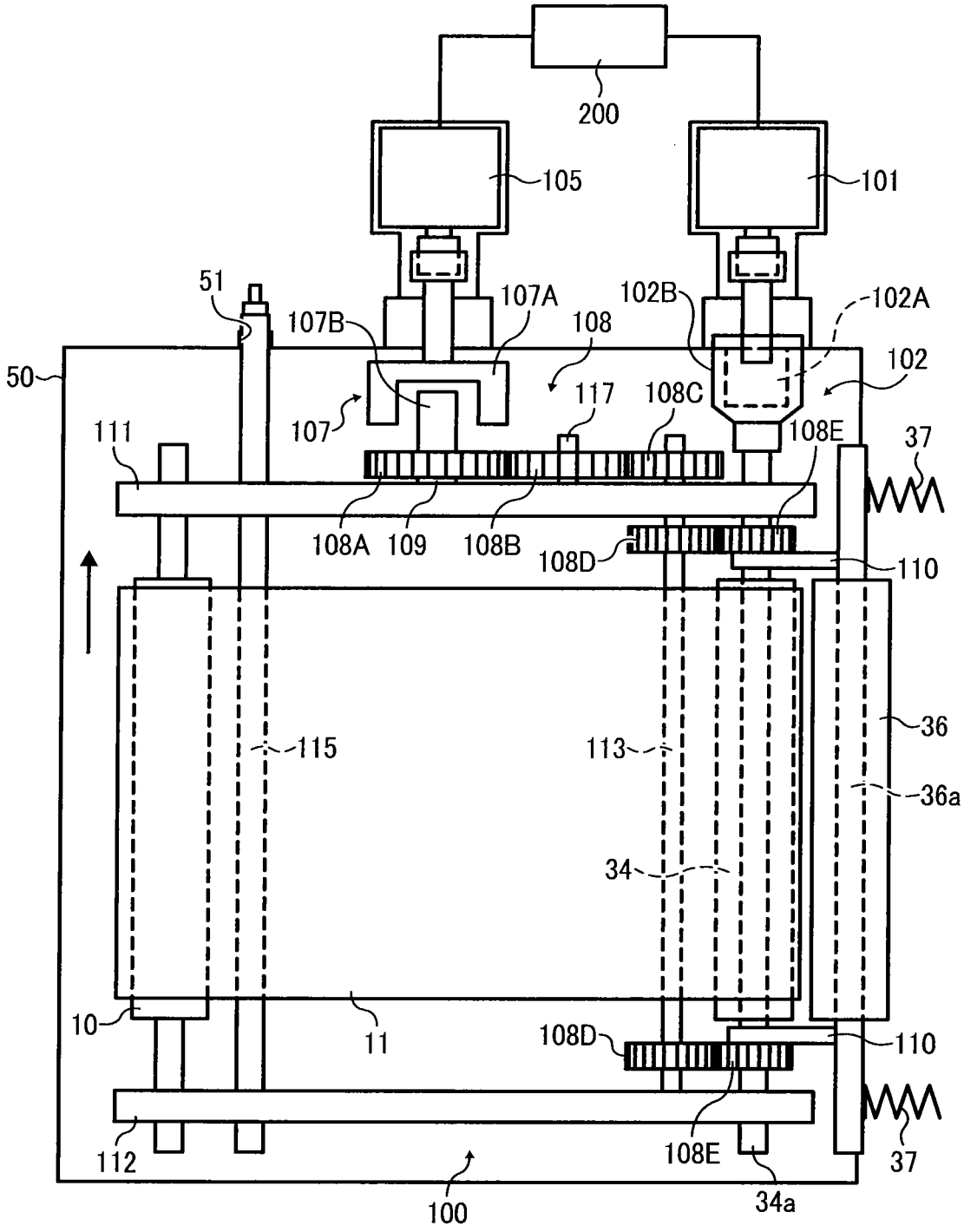
FIG. 4 is a schematic diagram illustrating the drive systems and the intermediate transfer unit in a state in which the intermediate transfer unit is installed in the main body of the image forming apparatus.

Next, with reference to FIGS. 3 and 4, a description is provided of a driving system of the moving cam 110 according Embodiment 1. FIG. 3 is a schematic diagram illustrating the intermediate transfer unit 100 when the intermediate transfer unit 100 is separated from the main body 50 of the image forming apparatus. FIG. 4 is a schematic diagram illustrating the intermediate transfer unit 100 when the intermediate transfer unit 100 is installed in the main body 50.

The driving system of the intermediate transfer unit 100 includes a drive motor 101 serving as a first drive source and a coupling device 102. The drive motor 101 is disposed in the main body 50 and drives the support roller 34 to rotate. The drive motor 101 can rotate forward and in reverse. The forward rotation of the drive motor 101 corresponds to rotation upon image formation. The forward rotation of the drive motor causes the intermediate transfer belt 11 to move in the counterclockwise direction (forward direction) in FIG. 1. As will be later described, the reverse rotation of the drive motor 101 causes the intermediate transfer belt 11 to move in the clockwise direction in FIG. 1. When to rotate in reverse is described later.

The coupling 102 includes a motor hub 102A and a unit hub 102B. The motor hub 102A is fixed to an output shaft 101*a* of the drive motor 101. The unit hub 102B is fixed to an end portion of the rotary shaft 34*a* of the support roller 34 at the intermediate transfer unit side. As illustrated in FIG. 4, the unit hub 102B engages the motor hub 102A when the intermediate transfer unit 100 is installed in the main body 50 of the image forming apparatus. The rotary driving power from the drive motor 101 can be transmitted to the rotary shaft 34*a* by engaging the motor hub 102A and the unit hub 102B. The engaging portion of the motor hub 102A and the unit hub 102B serves as a main reference upon installation of the intermediate transfer unit 100 in the main body 50.

Figure 2:
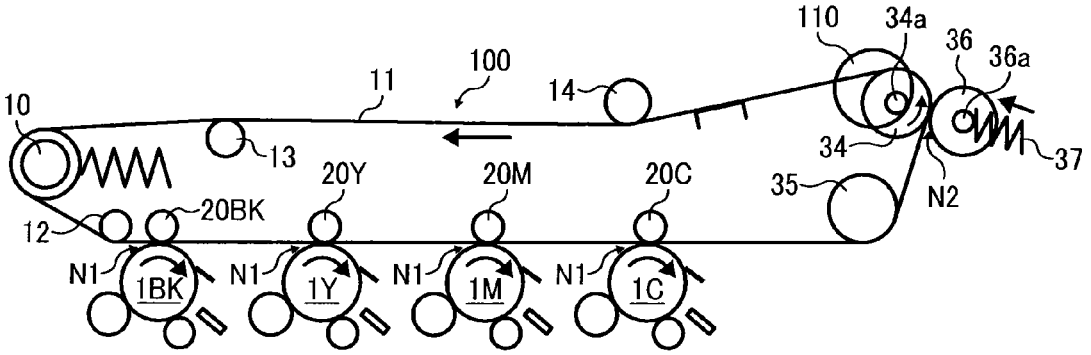
FIG. 2 is a schematic diagram illustrating an intermediate transfer unit and its surroundings employed in the image forming apparatus of FIG. 1.
Figure 5A:
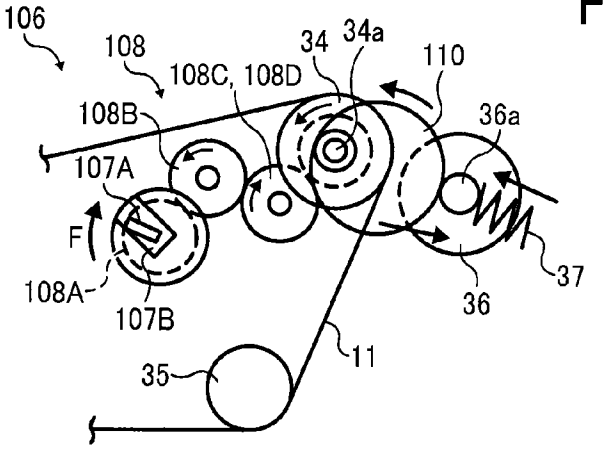
FIG. 5A is a schematic diagram illustrating a nip forming member (i.e., a transfer device) separated from an intermediate transfer member when a moving device and the intermediate transfer member rotate in the same direction.

As illustrated in FIG. 3, the drive system of the moving cam 110 includes a drive motor 105 serving as a second drive source and a drive transmission device 106 (illustrated in FIG. 5A). The drive motor 105 is disposed in the main body 50 and drives the moving cam 110 to rotate. The drive motor 105 can rotate forward and in reverse. The drive motor 105 is disposed offset in the direction of movement of the intermediate transfer belt 11 relative to the drive motor 101. The forward rotation of the drive motor 105 causes the moving cam 110 to rotate in the counterclockwise direction. The reverse rotation of the drive motor 105 causes the moving cam 110 to rotate in the clockwise direction in FIGS. 1 and 2.

The drive transmission device 106 includes a coupling device 107 and a gear train 108. The coupling device 107 includes a motor cup 107A fixed to an output shaft 105*a* of the drive motor 105 and a unit cup 107B disposed at the intermediate transfer unit side. The motor cup 107A and the unit cup 107B connect the drive motor 105 and the gear train 108. More specifically, the unit cup 107B is fixed to a shaft 109 which is rotatably supported by a plate 111 of the intermediate transfer unit 100.

As illustrated in FIG. 4, the unit cup 107B engages the motor cup 107A when the intermediate transfer unit 100 is installed in the main body 50 of the image forming apparatus. The rotary driving power from the drive motor 105 can be transmitted from the shaft 109 to the moving cam 110 via the gear train 108 by engaging the motor cup 107A and the unit cup 107B.

The gear train 108 includes, from the drive motor side, a first gear 108A as a first stage, a second gear 108B, a third gear 108C, fourth gears 108D, and fifth gears 108E which are the last stage. The first gear 108A is integrally disposed with the unit cup 107B on the shaft 109. The first gear 108A is rotatably supported by the shaft 109 fixed to the plate 111 of the intermediate transfer unit 100. The second gear 108B is fixed to a shaft 117 rotatably supported by the plate 111. The third gear 108C is fixed to a shaft 113 which penetrates through and is rotatably supported by the plate 111 and a plate 112 parallel to the plate 111. The first gear 108A through the third gear 108C are disposed outside the plate 111. The first gear 108A meshes with the third gear 108C via the second gear 108B.

The fourth gears 108D include two gears fixed to the shaft 113 and are disposed inside the plates 111 and 112, but outside the intermediate transfer belt 11. Each of the fourth gears 108D meshes with the fifth gear 108E. The fifth gears 108E are rotatably and integrally disposed on the moving cams 110. The rotary shaft 34*a* is rotatably supported by the plates 111 and 112.

A shaft 115 is disposed at the support roller 10 side relative to the shaft 109 to be connected to the drive motor 105 and penetrates through the plates 111 and 112. The shaft 115 serves as a sub-reference upon installation of the intermediate transfer unit 100 in the main body 50. Upon installation of the intermediate transfer unit 100 in the main body 50, the shaft 115 is inserted to a hole 51 formed in the main body 50. The drive motor 101 engages the coupling device 102 at the unit side, and the shaft 115 is inserted to the hole 51, thereby positioning the intermediate transfer unit 100 in place relative to the main body 50.

Because the moving cam 110 is spaced apart from the drive motor 105 due to an arrangement of devices, the gear train 108 is used as a part of the drive transmission device 106. However, the longer the drive transmission path is, the more backlash or play is generated between the gears of the gear train 108 and in the coupling device 107. As a result, backlash in the direction of rotation of the moving cam 110 at the initial rotation thereof increases.

In the image forming apparatus, the intermediate transfer unit 100 is detachably attachable relative to the main body 50, and the drive motors 101 and 105 are disposed in the main body 50. In this configuration, the coupling device 107, in particular, may need to include a clearance to accommodate the backlash upon installation or removal of the intermediate transfer unit 100, gaps due to variations in tolerances of parts, and accumulated variations in assemblies of parts. Therefore, the rotary driving power including the backlash with the amount of the clearance of the coupling device 107 is transmitted to the moving cam 110, generating more backlash in the direction of rotation of the moving cam 110.

In a case in which the moving cam 110 is driven to rotate via the gear train 108 and the drive transmission device 106 of the coupling device 107, as illustrated in FIG. 5, each of the gear train 108 and the coupling device 107 contacts at the upstream side (drive source side) and rotates. Accordingly, the moving cam 110 disposed at the extreme downstream end of the drive transmission device 106 has backlash only when rotating in the forward direction. By contrast, when rotating in reverse (in the opposite direction), the moving cam 110 does not have backlash.

Figure 5B:
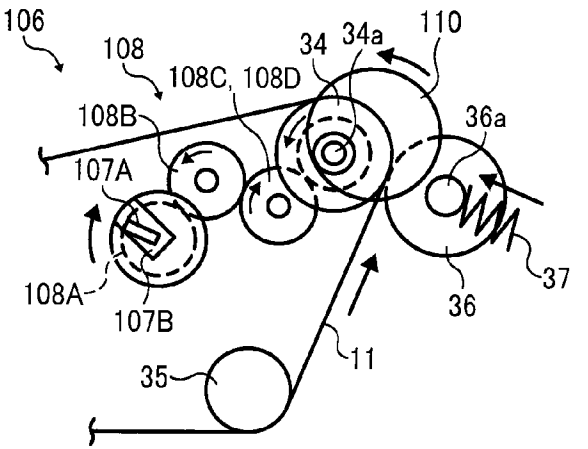
FIG. 5B is a schematic diagram illustrating the nip forming member contacting the intermediate transfer member when the moving device and the intermediate transfer member rotate in the same direction.
Figure 5C:
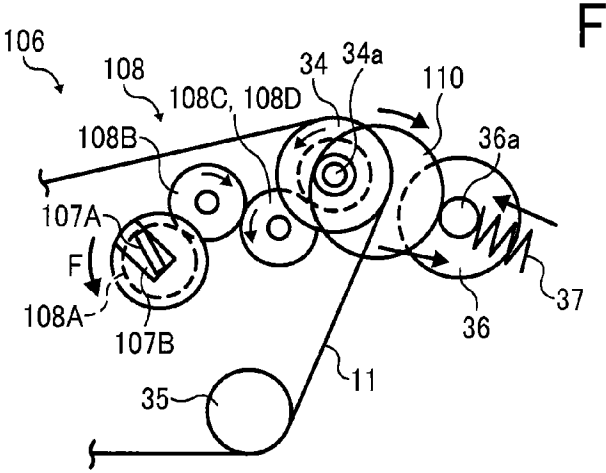
FIG. 5C is a schematic diagram illustrating the nip forming member separated from the intermediate transfer member when the moving device and the intermediate transfer member rotate in opposite directions to each other.
Figure 5D:
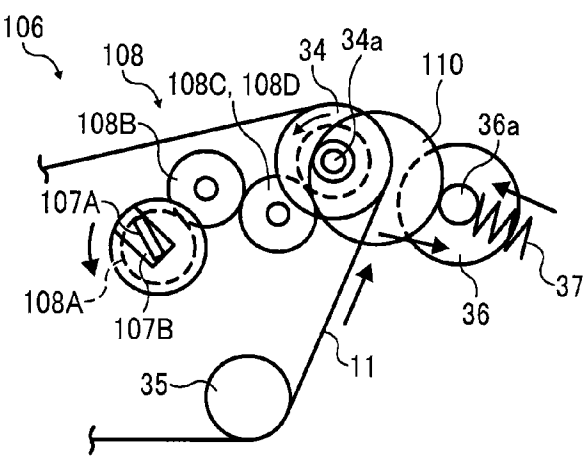
FIG. 5D is a schematic diagram illustrating the nip forming member separated from the intermediate transfer member when the moving device and the intermediate transfer member rotate in opposite directions to each other.

FIGS. 5A and 5B illustrate a state in which the moving cam 110 and the support roller 34 rotate in the same direction. FIGS. 5C and 5D illustrate a state in which the moving cam 110 and the support roller 34 rotate in opposite directions to each other. In FIGS. 5A through 5D, an arrow F indicates a direction of rotation of the drive motor 105.

In a case in which the moving cam 110 and the support roller 34 rotate in the same direction, as the moving cam 110 rotates forward from a separated state shown in FIG. 5A to a contact state shown in FIG. 5B, backlash is generated at the coupling device 107 in the direction of rotation of the support roller 34. As a result, when the support roller 34 rotates in the counterclockwise direction (forward rotation), the moving cam 110 may rotate forward (counterclockwise) by an amount of backlash due to a frictional force between the support roller 34 and the moving cam 110. In particular, during the separated state in which the moving cam 110 is pressed by the secondary transfer roller 36, the frictional force between the support roller 34 and the moving cam 110 increases, thereby increasing a risk of rotating the support roller 34 and the moving cam 110 forward (counterclockwise).

Even when the moving cam 110 rotates forward by the amount of backlash, as long as the position of the moving cam 110 changes within the range of top dead center thereof the position of the secondary transfer roller 36 does not change. In other words, as long as the change in the position is within a permissible range, it does not cause a problem. However, in a case in which the top dead center range of the moving cam 110 cannot not be secured adequately, the change in the position of the secondary transfer roller 36 exceeds the permissible range due to displacement of the moving cam 110 in the direction of rotation by the amount of backlash. As a result, the secondary transfer roller 36 is not separated adequately.

In view of the above, in the separated state in which at least the moving cam 110 presses against the shaft 36*a* of the secondary transfer roller 36 which is, then, separated from the intermediate transfer belt 11, the direction of rotation of the moving cam 110 does not coincide with the direction of rotation of the support roller 34 (or the moving cam 110 does not rotate). In other words, in a state in which the secondary transfer roller 36 and the intermediate transfer belt 11 are separated, the moving cam 110 and the support roller 34 rotate in opposite directions to each other.

More specifically, in a state in which the intermediate transfer belt 11 and the secondary transfer roller 36 are separated, a controller 200 shown in FIGS. 1 and 3 controls the drive motors 101 and 105 to rotate the support roller 34 in the direction opposite that of the moving cam 110. The controller 200 includes a computer including, but not limited to a (CPU) or an operation circuit, and serves as a restriction device. As illustrated in FIG. 3, the drive motors 101 and 105 are connected to the controller 200 via signal lines and are under the control of the controller 200.

As illustrated in FIGS. 5C and 5D, as the controller 200 controls the drive motors 101 and 105 such that the direction of rotation of the moving cam 110 and the direction of rotation of the support roller 34 are opposite to each other, the moving cam 110 has backlash in the direction opposite that of the support roller 34. Accordingly, even when the support roller 34 rotates while the secondary transfer roller 36 is separated from the intermediate transfer belt 11, the moving cam 110 does not rotate and hence the position of the secondary transfer roller 36 does not change. With this configuration, the moving cam 110 is prevented from following the rotation of the support roller 34. Furthermore, displacement of the secondary transfer roller 36 in the separated state is prevented reliably. That is, undesirable rotation of the moving cam 110 is prevented reliably, hence preventing a separation error of the secondary transfer roller 36 and the intermediate transfer belt 11.

Next, a description is provided of when to rotate the moving cam 110 and the support roller 34 in opposite directions to each other.

When forming an image in accordance with a document image (during the image forming operation), the secondary transfer roller 36 pressingly contacts the intermediate transfer belt 11 so as to form the secondary transfer nip N2 therebetween. Thus, the controller 200 controls the drive motor 101 such that at a time during which the number of pages to be printed is input and printing of the predetermined number of pages is completed the secondary transfer roller 36 is in contact with the intermediate transfer belt 11 and the intermediate transfer belt 11 rotates forward.

Figure 6:
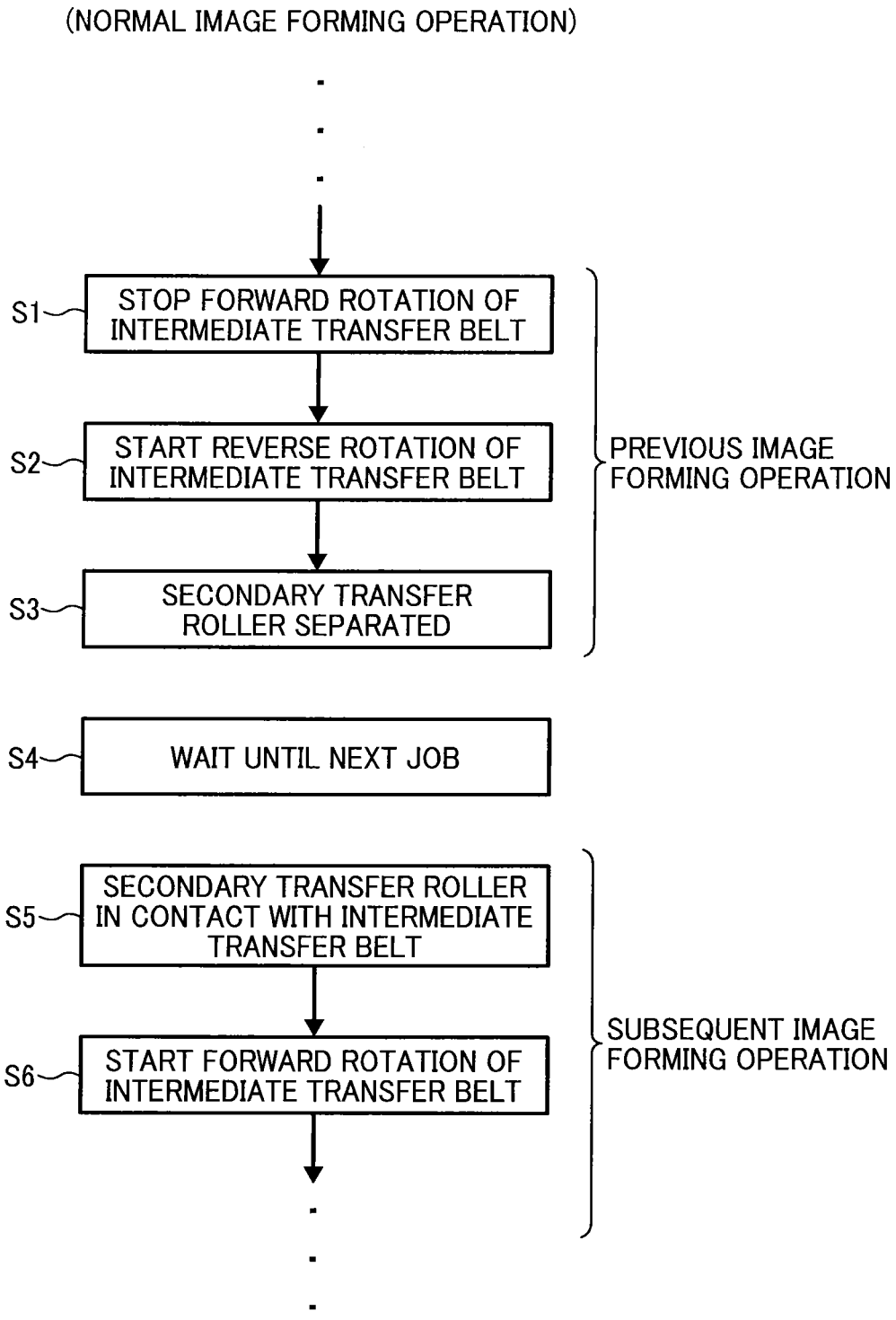
FIG. 6 is a flowchart showing steps in a control for the drive systems for the intermediate transfer member and for the moving device.

After printing of the predetermined number of pages is completed, as shown in the flowchart in FIG. 6, the controller 200 halts the drive motor 101 in order to stop the forward rotation of the intermediate transfer belt 11 at step S1. Subsequently, the controller 200 rotates the drive motor 101 in reverse to rotate the intermediate transfer belt 11 in reverse (in the clockwise direction) at step S2 while driving the drive motor 105 to rotate forward so that the moving cam 110 rotates 180 degrees counterclockwise to separate the secondary transfer roller 36 from the intermediate transfer belt 11 at step S3. The controller 200 keeps the secondary transfer roller 36 separated from the intermediate transfer belt 11 until the next image forming operation (next job) in accordance with the next document image starts at step S4.

As the next image forming operation starts, the controller 200 drives the drive motor 105 to rotate the moving cam 110 180 degrees counterclockwise, thereby moving the secondary transfer roller 36 towards the intermediate transfer belt 11 at step S5. That is, the secondary transfer roller 36 contacts the intermediate transfer belt 11. Subsequently, the controller 200 drives the drive motor 101 to rotate forward, thereby initiating the forward rotation of the intermediate transfer belt 11 at step S6.

In a case in which the directions of rotation of the moving cam 110 and the support roller 34 are opposite to each other, when the secondary transfer roller 36 is in the separated state, the drive motor 105 rotates forward after the intermediate transfer belt 11 rotates in reverse. Consequently, the reverse rotation of the support roller 34 causes the moving cam 110 to follow the rotation of the support roller 34. Thus, there is a concern that such movement of the moving cam 110 causes the secondary transfer roller 36 in the separated state to move toward and contact the intermediate transfer belt 11. The secondary transfer roller 36 may be left contacting the intermediate transfer belt 11 until the next job.

In view of the above, in a case in which the directions of rotation of the moving cam 110 and the support roller 34 are opposite to each other, the intermediate transfer belt 11 is rotated in reverse prior to moving the moving cam 110 in the separating direction, hence preventing the moving cam 110 from getting rotated. In other words, the moving cam 110 is prevented from getting rotated by rotating the intermediate transfer belt 11 in reverse prior to rotating the drive motor 105 forward while the secondary transfer roller 36 is in the separated state. With this configuration, undesirable rotation of the moving cam 110 is prevented reliably, hence preventing a separation error of the secondary transfer roller 36 and the intermediate transfer belt 11.

Embodiment 2

Figure 7:
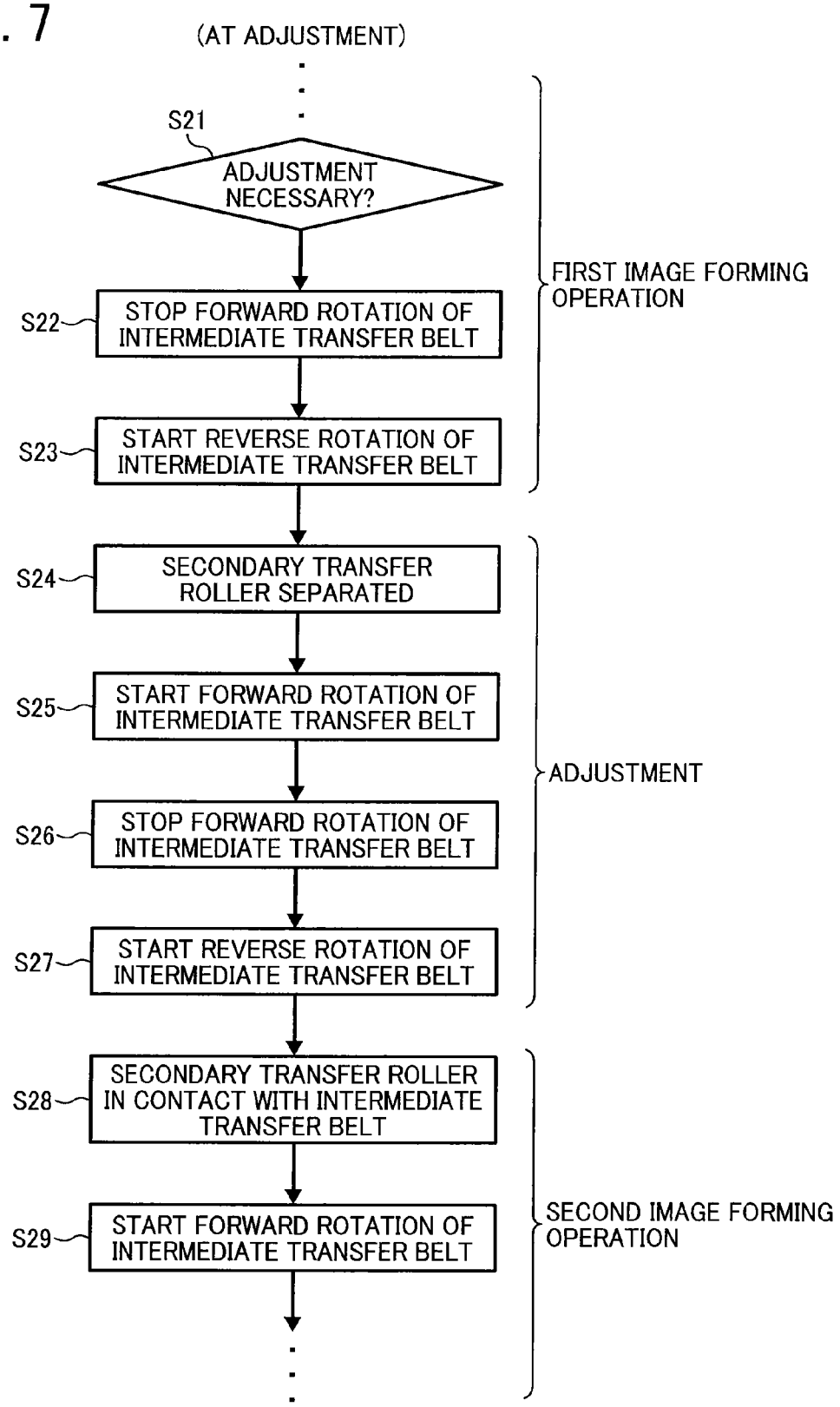
FIG. 7 is a flowchart showing steps in a main control according to a second illustrative embodiment of the present disclosure.

With reference to FIG. 7, a description is provided of Embodiment 2 of the present disclosure. According to the present illustrative embodiment, the controller 200 controls the drive motor 101 serving as a first drive source such that the rotary shaft rotates in a direction opposite that of the moving device at a time between an adjustment operation carried out after first image forming operation and a second image forming operation in which a toner image is formed on the image bearing member after the adjustment operation.

In general, in an electrophotographic image forming apparatus, the adjustment operation is carried out between the first image forming operation and the second image forming operation. The adjustment operation includes a known adjustment operation to adjust a toner density by forming a test pattern for toner density adjustment on the intermediate transfer belt 11. The adjustment is carried out every time the preset predetermined number of pages is printed or a degree of change in the toner density exceeds a predetermined permissible range. The adjustment is performed after the previous job is completed or in the middle of the job. During the adjustment, the test pattern is not transferred onto the recording medium P. Thus, the secondary transfer roller 36 is in the separated state in which the secondary transfer roller 36 is separated from the intermediate transfer belt 11.

According to the present illustrative embodiment, the intermediate transfer belt 11 is rotated in reverse at a time between the adjustment operation carried out after the first image forming operation and the second image forming operation in which a toner image is formed on the image bearing member after the adjustment operation. More specifically, the reverse rotation of the intermediate transfer belt 11 during the adjustment operation causes the support roller 34 and the moving cam 110 that separates the secondary transfer roller 36 from the intermediate transfer belt 11 to rotate together, thereby moving the secondary transfer roller 36 in the separated state towards the intermediate transfer belt 11. As a result, the secondary transfer roller 36 contacts the intermediate transfer belt 11. With reference to FIG. 7, a description is provided of a procedure of the control exerted by the controller 200. FIG. 7 is a flowchart showing the procedure of the control exerted by the controller 200.

As shown in FIG. 7, for example, after the controller 200 counts the number of printed pages that requires the adjustment operation, the controller 200 decides whether the adjustment operation needs to be carried out at step S21, and stops the drive motor 101 to stop the forward rotation of the intermediate transfer belt 11 at step S22. Alternatively, as illustrated in FIG. 1, a toner density detector 15 may be disposed opposite the intermediate transfer belt 11 to provide toner density information. The adjustment timing may be determined based on the toner density information provided by the toner density detector 15.

The controller 200 rotates the drive motor 101 in reverse to rotate the intermediate transfer belt 11 in reverse (in the clockwise direction) at step S23 while rotating the drive motor 105 forward, causing the moving cam 110 to rotate 180 degrees counterclockwise and thus moving the secondary transfer roller 36 to the separated position at step S24. In other words, the moving cam 110 is prevented from getting rotated by the rotation of the support roller 34 by rotating the drive motor 101 in reverse to move the intermediate transfer belt 11 in reverse prior to rotating the drive motor 105 forward while the secondary transfer roller 36 is in the separated state.

Subsequently, at step S25, the controller 200 drives the drive motor 101 to rotate forward to initiate the forward rotation of the intermediate transfer belt 11 so that the test pattern for adjustment of the toner density formed by the image forming unit is transferred onto the intermediate transfer belt 11. The controller 200 executes the toner density adjustment using the test pattern. After the adjustment, the controller 200 stops the drive motor 101 to finish the forward rotation of the intermediate transfer belt 11 at step S26.

Subsequently, The controller 200 drives the drive motor 101 to rotate in reverse, thereby moving the intermediate transfer belt 11 in reverse (in the clockwise direction) at step S27. Then, the moving cam 110 is rotated by the rotation of the support roller 34 due to the frictional force with the support roller 34. As a result, the secondary transfer roller 36 in the separated state moves towards the intermediate transfer belt 11 and contacts the intermediate transfer belt 11 at step S28. At step S29, the intermediate transfer belt 11 rotates forward.

Conventionally, an operation (or a step) in which the drive motor is activated to rotate the moving cam so that the secondary transfer roller contacts the intermediate transfer belt is required after the adjustment of the toner density. By contrast, according to the present illustrative embodiment, the drive motor 101 is rotated in reverse after adjustment of the toner density, thereby rotating in reverse the intermediate transfer belt 11. This configuration enables the secondary transfer roller 36 to contact the intermediate transfer belt 11 so that an operation or a step for making the secondary transfer roller 36 to contact in the subsequent image forming operation (the second image forming operation) is not necessary.

In other words, in a case in which the subsequent image forming operation starts after the adjustment, the reverse rotation of the intermediate transfer belt 11 takes place before the moving cam 110 is rotated. Accordingly, the moving cam 110 gets rotated, and the contact time of the secondary transfer roller 36 during the subsequent image forming operation can be reduced, hence reducing a downtime or a time during which the device is not operated due to the adjustment.

According to the present illustrative embodiment, an example of the adjustment includes the adjustment of the toner density. However, the adjustment is not limited thereto. For example, the adjustment may include adjustment of a color drift in the toner image. More specifically, the control of the present illustrative embodiment may be carried out during the adjustment of a color drift in the toner image on the intermediate transfer belt 11. Similar to the foregoing illustrative embodiments, this configuration reduces the contact time of the secondary transfer roller 36 during the subsequent image forming operation, hence reducing the downtime due to the adjustment time.

Embodiment 3

Figure 8A:
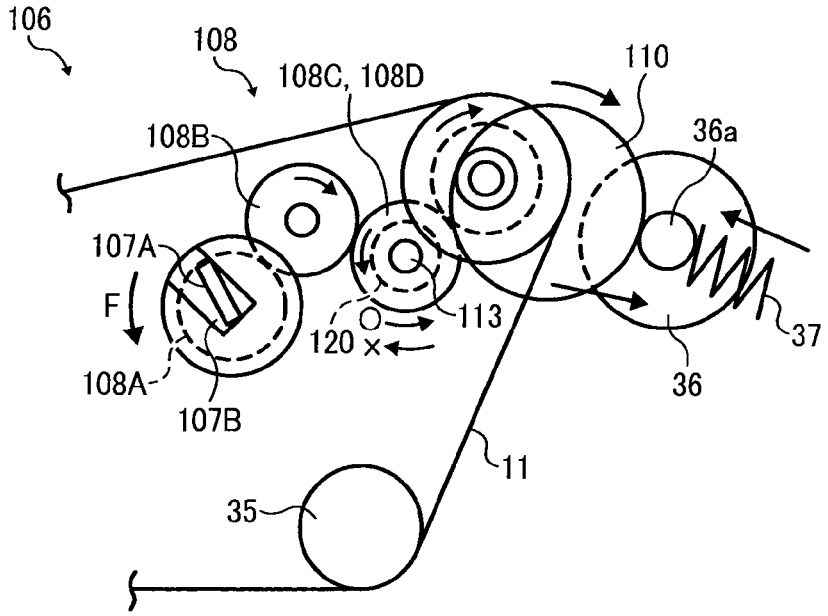
FIG. 8A is a schematic diagram illustrating the nip forming member separated from the intermediate transfer member when the moving device and the intermediate transfer member rotate in the same direction according to a third illustrative embodiment of the present disclosure.
Figure 8B:
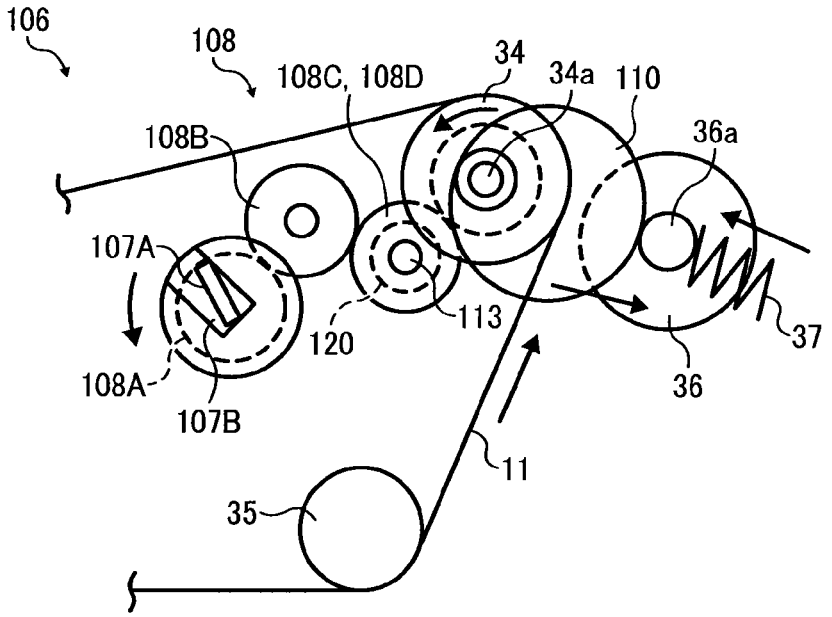
FIG. 8B is a schematic diagram illustrating the nip forming member separated from the intermediate transfer member after the moving device and the intermediate transfer member rotated in the same direction according to the third illustrative embodiment of the present disclosure.

With reference to FIGS. 8A and 8B, a description is provided of Embodiment 3 of the present disclosure. According to the present illustrative embodiment, the driving system of the moving cam 110 is different from the foregoing illustrative embodiments. More specifically, as illustrated in FIGS. 8A and 8B, a clutch 120 serving as a one-way transmission device is disposed in the drive transmission path (i.e., the gear train 108) between the drive motor 105 of the main body 50 to the moving cam 110.

When rotating the moving cam 110 and the support roller 34 in opposite directions to each other, the clutch 120, upon inputting the rotary driving power in the forward direction from the drive motor 105, transmits the rotary driving power to the moving cam 110 to rotate the moving cam 110 forward. Upon inputting the rotary driving power from the rotary shaft 34*a* (support roller 34) that supports the moving cam 110, the clutch 120 rotates idle. In other words, the clutch 120 transmits the forward rotation from the drive motor 105 to rotate the moving cam 110. However, the clutch 120 does not rotate in the direction of rotation of the rotary shaft 34*a* (support roller 34) supporting the moving cam 110.

According to the present illustrative embodiment, the clutch 120 is disposed between the shaft 113 and the fourth gear, i.e., the gear 108C. However, the mounting position of the clutch 120 is not limited to the position described above.

According to the present illustrative embodiment, in the drive system of the moving cam 110, as illustrated in FIG. 8A, the clutch 120 rotates in the direction of rotation (counterclockwise) of the drive motor 105 so as to transmit the rotary driving power to the moving cam 110, but does not rotate in the clockwise direction. As a result, as illustrated in FIG. 8B, the moving cam 110 rotates in the clockwise direction which is opposite the direction of rotation of the intermediate transfer belt 11 which rotates in the counterclockwise direction. That is, the moving cam 110 does not rotate in the same direction as that of the intermediate transfer belt 11.

With this configuration, the moving cam 110 is prevented from getting rotated by the rotation of the support roller 34, hence preventing undesirable change in the position of the secondary transfer roller 36 in the separated state. Accordingly, undesirable rotation of the moving cam 110 is prevented reliably, hence preventing a separation error of the secondary transfer roller 36 and the intermediate transfer belt 11.

Embodiment 4

Figure 9:
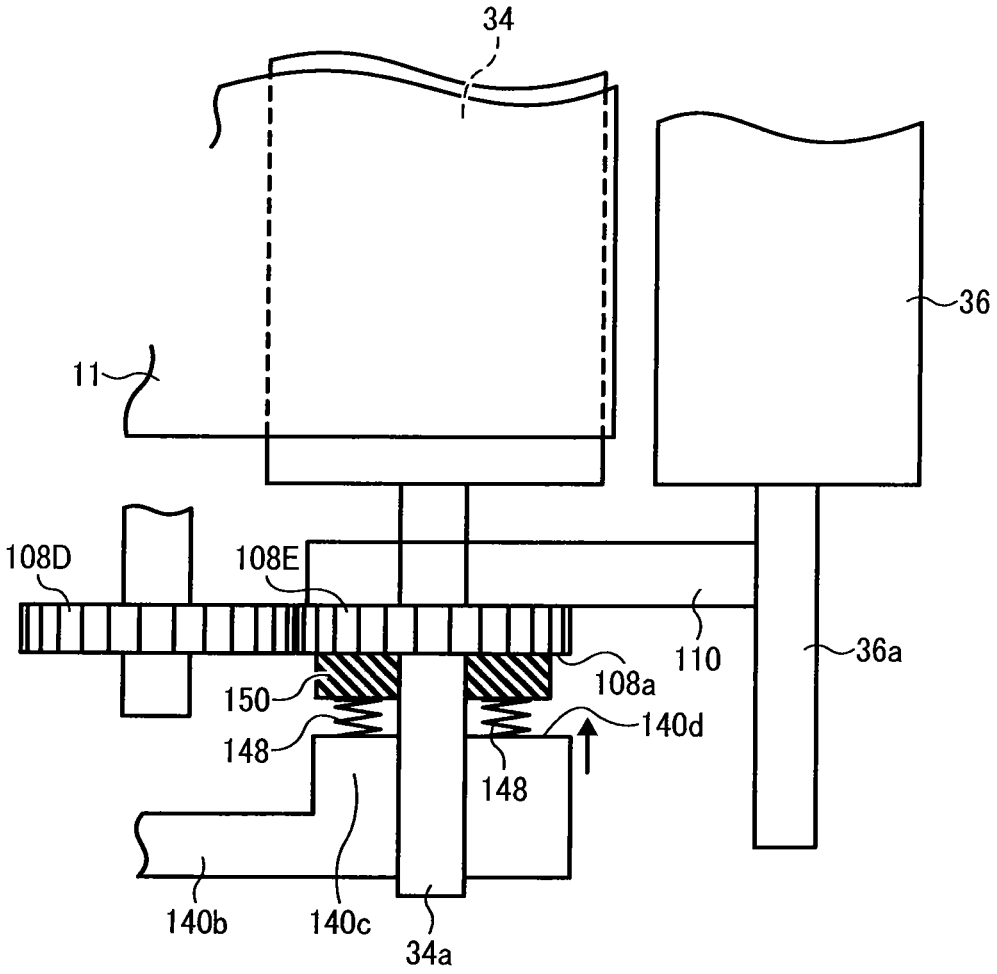
FIG. 9 is a partially enlarged view schematically illustrating a restriction member according to a fourth illustrative embodiment of the present disclosure.
Figure 10:
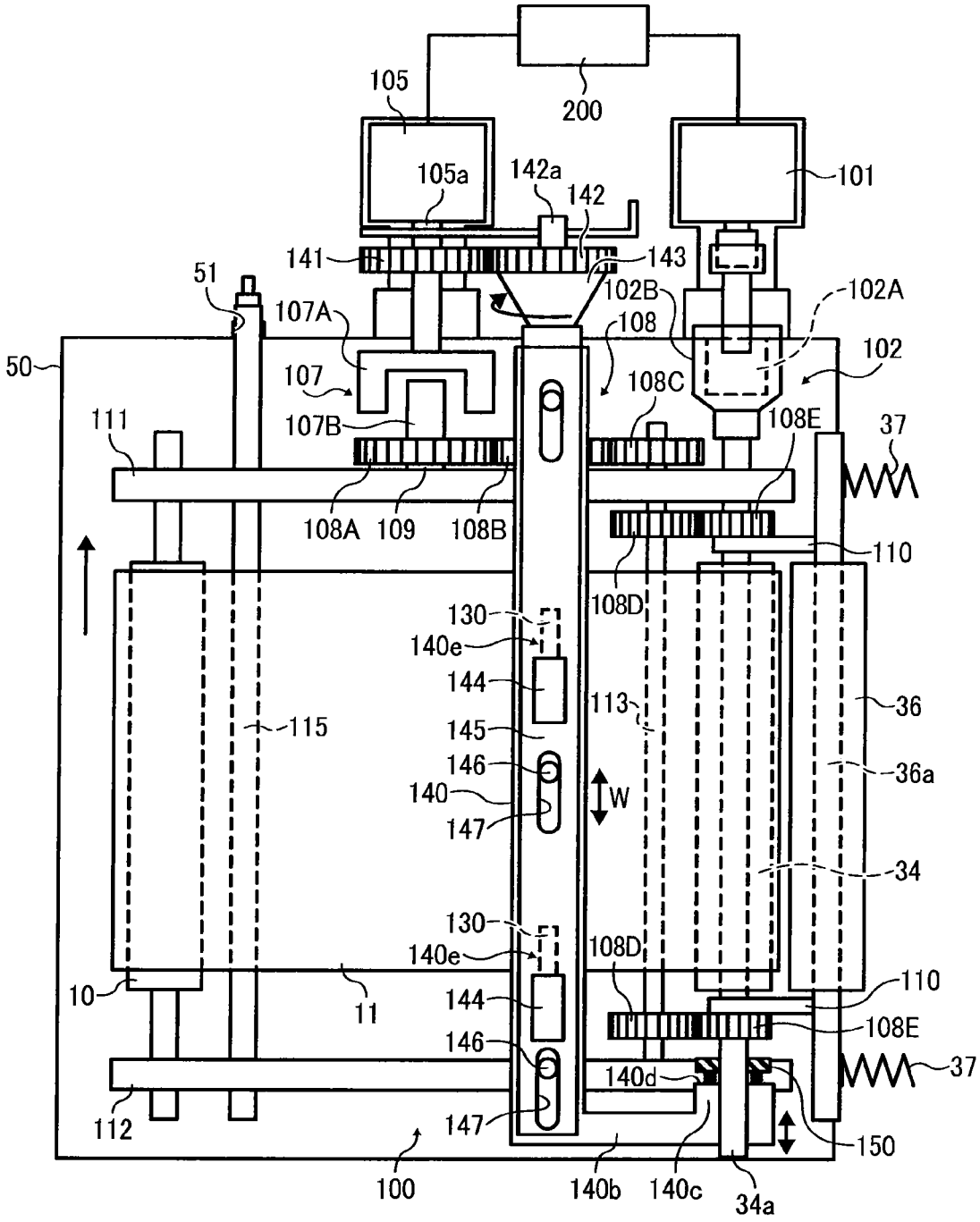
FIG. 10 is a schematic diagram illustrating a shutter, the moving device, and the restriction member in a state in which the shutter is closed according to the fourth illustrative embodiment of the present disclosure.
Figure 11:
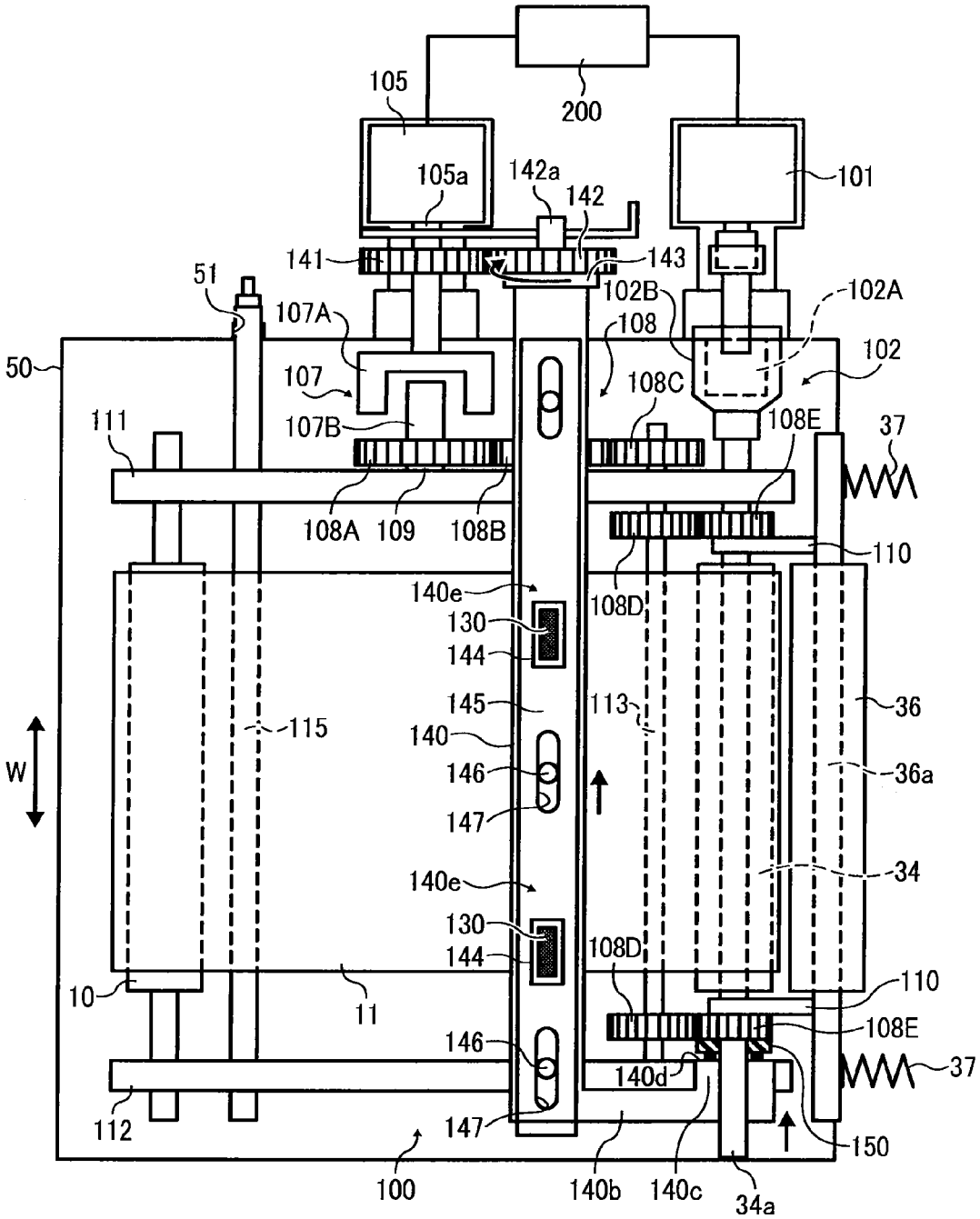
FIG. 11 is a schematic diagram illustrating the shutter, the moving device, and the restriction member in a state in which the shutter is opened according to the fourth illustrative embodiment of the present disclosure.

With reference to FIGS. 9, 10, and 11, a description is provided of Embodiment 4 of the present disclosure. According to the present illustrative embodiment, in a state in which the secondary transfer roller 36 serving as a nip forming member is separated from the intermediate transfer belt 11 by the rotation of the moving cam 110, a different control device, different from the controller 200, is employed to regulate the rotation of the moving cam 110.

As illustrated in FIG. 9, the image forming apparatus as an example of a copier includes a restriction member 150 to regulate rotation of the moving cam 110 by contacting the moving cam 110 when the secondary transfer roller 36 is in the separated state.

According to the present illustrative embodiment, the restriction member 150 is formed of material having a relatively large friction coefficient. The restriction member 150 inhibits rotation of the moving cam 110 by pressingly contacting a surface 108*a* of the fifth gear, i.e., the gear 108E integrally disposed with the moving cam 110, while the moving cam 110 is driven to rotate by the drive source 105 (second drive source) and the secondary transfer roller 36 is separated from the intermediate transfer belt 11.

The material having a relatively large friction coefficient includes, but is not limited to, rubber and any suitable material having a surface roughness greater (rougher) than that of the surface (metal surface) of the rotary shaft 34*a* of the moving cam 110. The "relatively large friction coefficient" herein refers to a friction coefficient relatively greater than a friction coefficient of the rotary shaft 34*a* and the moving cam 110 (e.g., thermoplastic resin such as polyacetal and acetal). The concept of "relatively large friction coefficient" refers also to a large contact area, a large contact pressure, and so forth, that cause a large frictional force (absolute value).

According to the present illustrative embodiment, when the secondary transfer roller 36 is in the separated state in which the secondary transfer member 36 is separated from the intermediate transfer belt 11, the restriction member 150 having a relatively large friction coefficient pressingly contacts the moving cam 110 (the surface 108*a* of the fifth gear 108E), thereby inhibiting rotation of the moving cam 110. With this configuration, undesirable rotation of the moving cam 110 is prevented reliably, hence preventing a separation error of the secondary transfer roller 36 and the intermediate transfer belt 11.

If the restriction member 150 and the moving cam 110 (the surface 108*a* of the fifth gear 108E) remain pressing against each other, a load is applied to rotation of the rotary shaft 34*a* in cases other than the separation state of the secondary transfer roller 36. For this reason, preferably, the restriction member 150 pressingly contacts the moving cam 110 (the surface 108*a* of the fifth gear 108E) in the separated state, and the restriction member 150 is separated from the moving cam 110 (the surface 108*a* of the fifth gear 108E) in a state other than the separated state. In other words, the restriction member 150 contacts with or without pressure and separates from the moving cam 110.

As illustrated in FIGS. 10 and 11, according to the present illustrative embodiment, the image forming apparatus includes a toner density detector 130 and a shutter 140. The toner density detector 130 detects the toner density of the toner image on the intermediate transfer belt 11. The shutter 140 is a moving body and is disposed between the intermediate transfer belt 11 and the toner density detector 130 so as to block detection light emitted from the toner density detector 130. The shutter 140 is movable between a light permission position at which the shutter 140 allows the detection light to pass and a shield position at which the shutter 140 blocks the detection light.

The restriction member 150 is mounted on the shutter 140, thereby enabling the restriction member 150 to contact and separate from the moving cam 110. More specifically, the shutter 140 includes a shield portion 140*e* which is movable between the light permission position allowing the light to pass and the shield position. The light permission position herein refers to an open position of the shutter 140 at which the shutter 140 is opened as illustrated in FIG. 11. The shield position herein refers to a position at which the shutter 140 is closed as illustrated in FIG. 10.

The device for moving and driving the restriction member 150 can be provided as a single designated unit. Preferably, however, the device for moving and driving the restriction member 150 may move in conjunction with the shutter 140 for cost reduction. In other words, detection of toner density of the toner image on the intermediate transfer belt 11 is a required configuration to adjust the position and the density of the image.

In view of the above, the restriction member 150 is mounted on the shutter 140, allowing the restriction member 150 to move in conjunction with the movement of the shutter 140, hence reducing the cost and an installation space while inhibiting rotation of the moving cam 110. With this configuration, undesirable rotation of the moving cam 110 is prevented reliably, hence preventing a separation error of the secondary transfer roller 36 and the intermediate transfer belt 11.

According to the present illustrative embodiment, in conjunction with the movement of the shutter 140, the restriction member 150 pressingly contacts the moving cam 110 and inhibits the movement thereof in the direction of rotation. When the shutter 140 moves to the light permission position, the restriction member 150 pressingly contacts the moving cam 110.

In general, the shutter 140 for the toner density detector 130 opens when the secondary transfer roller 36 in a non-image formation state is separated from the intermediate transfer belt 11. Thus, the movement of the restriction member 150 relative to the moving cam 110 can be linked to the movement of the shutter 140. More specifically, as illustrated in FIGS. 10 and 11, a drive gear 141 is disposed on a drive shaft 105*a* of the drive motor 105 disposed at the main body (50) side such that the drive gear 141 rotates together with the drive shaft 105*a*.

Figure 12:
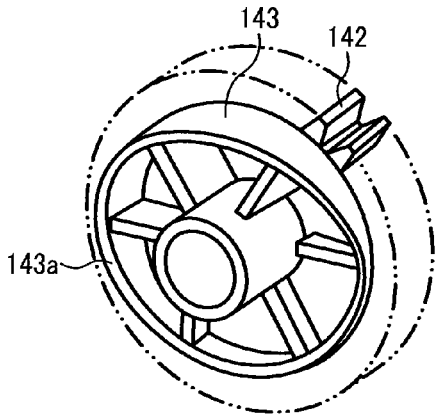
FIG. 12 is a partially enlarged perspective view schematically illustrating a cam for moving a moving body.

The drive gear 141 meshes with a gear 142 rotatably supported by a shaft 142*a* which is fixed to the main body (50) side. As illustrated in FIG. 12, the gear 142 includes a cam 143 for opening and closing the shutter 140. The cam 143 is constituted as a single integrated member with the gear 142. With this configuration, as the drive motor 105 is driven, the drive force is transmitted via the drive gear 141 and the gear 142, thereby rotating the cam 143.

Figure 13:
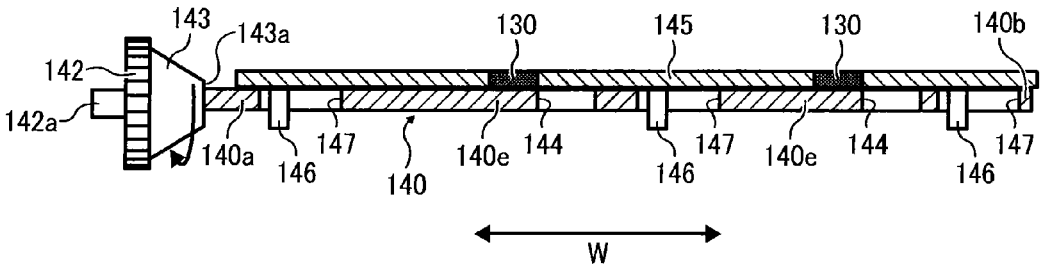
FIG. 13 is a schematic diagram illustrating an open-close mechanism of the moving body.

As illustrated in FIG. 13, the shutter 140 is slidably supported by a support member 145 on which the toner density detector 130 is disposed. The support member 145 includes a pin 146 that projects from the support member 145. The support member 145 supports the shutter 140 by inserting the pin 146 into an elongate hole 147 formed in the shutter 140. The shutter 140 includes an opening 144. The opening 144 is formed in the shutter 140 in such a position that when the shutter 140 is opened as illustrated in FIG. 11 the shutter 140 does not face the toner density detector 130, thereby preventing the shutter 140 from blocking an illumination of the detection light.

According to the present illustrative embodiment, two toner density detectors 130 are disposed on the support member 145. More specifically, the toner density detectors 130 are placed at a distance from each other in an axial direction indicated by a double-headed arrow W. According to the present illustrative embodiment, the sliding direction of the shutter 140 coincides with the direction of movement of the restriction member 150. As illustrated in FIG. 13, one shield portion 140*e* is formed near or substantially at the left of each opening 144 such that when the shutter 140 is closed as illustrated in FIG. 10 the shield portion 140*e* faces the toner density detector 130.

An end portion 140*a* of the shutter 140 is always in contact with a cam surface 143*a* of the cam 143. Accordingly, as the cam 143 rotates, the shutter 140 moves in the axial direction indicated by the double-headed arrow W (direction of movement). The other end of the shutter 140, that is, an end portion 140*b*, is bent into a sidewardly-open U-shape facing the end portion 140*a* in planar view. A bent portion 140*c* of the end portion 140*b* is slidably supported in the axial direction of the rotary shaft 34*a*.

The restriction member 150 has, for example, an annular shape to avoid the rotary shaft 34*a*, and is disposed on a surface 104*d* of the bent portion 140*c* facing the surface 108*a* of the fifth gear 108E via a compression spring 148 serving as a pressing device. The restriction member 150 is pressed against the surface 108*a* (moving cam 110) by the compression spring 148. With this configuration, when the restriction member 150 pressingly contacts the surface 108*a* (moving cam 110) such as shown in FIG. 11, a return force which causes the shutter 140 to return to the close position shown in FIG. 10 is exerted by the compression spring 148.

In a state in which the shutter 140 is at the close position as illustrated in FIG. 10, the restriction member 150 is separated from the surface 108*a* (moving cam 110). By contrast, in a state in which the shutter 140 is at the open position as illustrated in FIG. 11, the restriction member 150 pressingly contacts the surface 108*a* (moving cam 110).

With this configuration, the restriction member 150 can move in conjunction with the movement of the shutter 140, hence reducing the cost and an installation space while restricting rotation of the moving cam 110. Accordingly, undesirable rotation of the moving cam 110 is prevented reliably, hence preventing a separation error of the secondary transfer roller 36 and the intermediate transfer belt 11.

According to the present illustrative embodiment, the drive motor 105 is used for both driving the moving cam 110 and moving the shutter 140 and the restriction member 150. With this configuration, the separation movement of the moving cam 110 and inhibition timing of the restriction member 150 can reliably meet as compared with driving the moving cam 110 and moving the restriction member 150 by different drive sources. Furthermore, the number of parts can be reduced, thereby reducing the cost and an installation space.

Because the moving cam 110 is disposed in the intermediate transfer unit 100, the moving cam 110 is connected to the drive motor 105 by the drive transmission device 106 equipped with the gear train 108. In this configuration, the drive transmission path is relatively long, and it is necessary to absorb backlash or play of the intermediate transfer unit 100 upon installation or removal of the intermediate transfer unit 100 from the main body 50. Thus, the coupling 107 including a space in the drive transmission path in the moving cam 110 is provided. As a result, the backlash of the moving cam 110 increases, thereby increasing an amount of displacement of the secondary transfer roller 36 due to its rotation.

In view of the above, preferably, the restriction member 150 pressingly contacts the moving cam 110 (the surface 108*a* of the fifth gear 108E) when the secondary transfer roller 36 is in the separated state in which the secondary transfer roller 36 is separated from the intermediate transfer belt 11. Accordingly, the rotation of the separation cam 110 is regulated. With this configuration, undesirable rotation of the moving cam 110 is prevented reliably, hence preventing a separation error of the secondary transfer roller 36 and the intermediate transfer belt 11.

The shutter 140 for the toner density detector 130 is installed in the main body 50 because there is no need to remove it from the main body 50. With this configuration, in a case in which the same drive motor, i.e., the drive motor 105 is used for both driving the moving cam 110 and moving the shutter 140, the drive force is transmitted to the cam 143 by the drive gear 141 fixed to the drive shaft 105*a* of the drive motor 105 and the gear 142 disposed next to or near the drive gear 141. This configuration can shorten the drive transmission path.

According to the present illustrative embodiment, the shutter 140 is opened and closed directly by the drive motor 105 using the cam 143. In this configuration, the coupling 107 does not involve in opening and closing the shutter 140 so that fluctuation of the shutter 140 is suppressed, thereby allowing the shutter 140 to be used as a restriction device for the moving cam 110.

According to the illustrative embodiment shown in FIG. 7, the secondary transfer roller 36 is in the separated state so that the adjustment operation is performed. Alternatively, the secondary transfer roller 36 may be in the separated state in other purposes.

Variation 1

Figure 15:
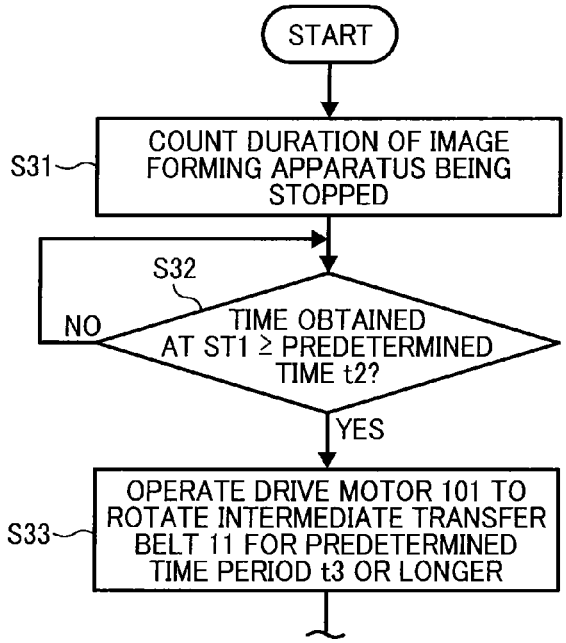
FIG. 15 is a flowchart showing steps in a main control according to Variation 1.

With reference to FIG. 15, a description is provided of Variation 1 of the present disclosure. In Variation 1, the secondary transfer roller 36 is in the separated state when the intermediate transfer belt 11 is rotated periodically in order to prevent the intermediate transfer belt 11 from getting a permanent curl shape after being left for an extended period of time, for example, when the intermediate transfer belt 11 is stopped, other than during the adjustment operation. FIG. 15 is a flowchart showing steps in a main control exerted by the controller 200 according to Variation 1.

More specifically, when the controller 200 detects that the image forming apparatus is stopped for a predetermined time period t2 such as in standby mode, the controller 200 enables the drive motor 101 to rotate the intermediate transfer belt 11 for a predetermined time period t3 or longer. Thus, the controller 200 of Variation 1 stores the values for the predetermined time periods t2 and t3 in the memory unit in advance. According to the present illustrative embodiment, the predetermined time periods t2 and t3 have the following relation: t2=t3, or t2<t3.

In Variation 1, at step S31, the controller 200 counts the time during which the image forming apparatus is stopped, and then the process advances to the next step. In Variation 1, the operation circuit such as the CPU serves as a counter that counts the time during which the image forming apparatus is stopped. At step S32, whether or not the intermediate transfer belt 11 is stopped for the predetermined time period (t2) is verified. If the image forming apparatus is stopped for the predetermined time period t2 (yes at S32), the intermediate transfer belt 11 is rotated for the predetermined time period t3 or longer to eliminate the creep occurred during the predetermined time period t2. With this configuration, a good imaging quality is obtained regardless of the material of the intermediate transfer belt 11 and so forth.

The intermediate transfer belt 11 is rotated as described above to prevent permanent curl of the intermediate transfer belt 11. Such preventive rotation of the intermediate transfer belt 11 may be performed during the adjustment operation illustrated in FIG. 7.

According to Variation 1, when performing the preventive rotation of the intermediate transfer belt 11 to prevent the permanent curl of the belt, the drive motor 101 is controlled such that the direction of rotation of the rotary shaft 34*a* is opposite that of the moving cam 110. Accordingly, undesirable rotation of the moving cam 110 is prevented reliably, hence preventing a separation error of the secondary transfer roller 36 and the intermediate transfer belt 11 and preventing reliably degradation of the intermediate transfer belt 11 and the secondary transfer roller 36 due to undesirable contact with each other. The product life thereof can be enhanced.

Variation 2

Figure 16:
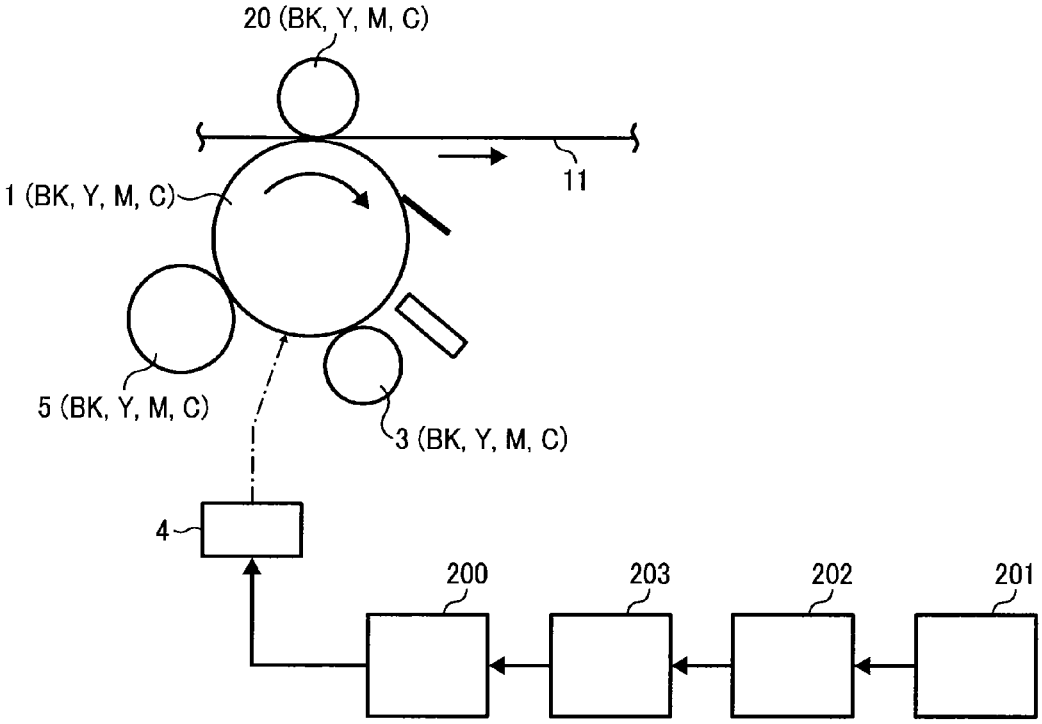
FIG. 16 is a block diagram showing a control according to Variation 2.

With reference to FIG. 16, a description is provided of Variation 2 of the present disclosure. According to Variation 2, the secondary transfer roller 36 is separated from the intermediate transfer belt 11, not during the adjustment operation, but during formation of strip patterns on each of the photosensitive drums (i.e., 1BK, 1Y, 1M, and 1C). More specifically, in order to eject periodically degraded toner in the developing devices, while the photosensitive drums (1BK, 1Y, 1M, and 1C) and the intermediate transfer belt 11 are rotated together to form the strip patterns on the photosensitive drums (1BK, 1Y, 1M, and 1C) the secondary transfer roller 36 is separated from the intermediate transfer belt 11.

First, a description is provided of ejection of the toner. It is to be noted that the structure of the image forming apparatus in Variation 2 is similar to or the same as FIG. 1. Thus, the description of the parts and devices having the same functions is omitted herein.

In the image forming units 40BK, 40Y, 40M, and 40C of the image forming apparatus according to Variation 2, a toner eject operation, in which the developing devices (i.e., the developing devices 5BK, 5Y, 5M, and 5C) eject toner forcibly, is performed at a predetermined timing other than at the image forming operation.

The predetermined timing herein refers to a time before rotation (hereinafter referred to as "pre-rotation"), after rotation (hereinafter referred to as "post rotation"), or between successive recording media sheets. The "pre-rotation" period herein refers to a preparation time during which devices used for image formation, such as the photosensitive drums 1BK, 1Y, 1M, and 1C, are driven before the image forming operation in which an image to be output on the recording medium P is formed. The "post rotation" period herein refers to a preparation time during which devices used for image formation, such as the photosensitive drums 1BK, 1Y, 1M, and 1C, are driven after the image forming operation. A time between successive recording media sheets herein refers to a time between successive recording media sheets in a continuous image forming operation relative to a plurality of recording media sheets.

In Variation 2, the controller 200 stores, in advance, a predetermined number (n) of sheets, predetermined values $\alpha 1$, $\alpha 2$, $\alpha 3$, and $\alpha 4$(%), and a threshold value Z.

FIG. 16 is a block diagram of the control in Variation 2. As illustrated in FIG. 16, when a document is read by an image reader 201, the image reader 201 separates the document image into individual color components or pixels and outputs a photoelectric conversion signal corresponding to the density of each pixel. The output from the image reader 201 is transmitted to an image signal processing circuit 202 which generates a pixel image signal with an output level corresponding to the density of the pixel. At this time, the level of the output signal of the image signal processing circuit 202 is counted for each pixel, and then each level is added by a video counter 203.

A video count value V, which is a sum of the output signals of each pixel, corresponds to an amount of toner to be consumed by the developing devices 5BK, 5Y, 5M, and 5C to form an image (toner image) on a sheet of recording medium. The video count value V also corresponds to a ratio (%) of an amount of toner consumed in actual image formation, that is, an image ratio (%) relative to a known amount of toner consumption when forming an image with a maximum density level in an entire image formation area.

The video count value V is added every time an image is formed on a sheet of recording medium, thereby calculating a video count summation value V(n). The summation signal, that is, the video count summation value V(n) is input to the operation circuit of the controller 200 and is stored in the memory unit. The video count summation value V(n) is obtained for each of the image forming units 40BK, 40Y, 40M, and 40C and stored in the memory unit. The video count summation values V1(n), V2(n), V3(n), and V4(n) represent the video count summation value of each of the image forming units 40BK, 40Y, 40M, and 40C, respectively. The video count summation values V1(n), V2(n), V3(n), and V4(n) correspond to the sum of the above-described image ratios (image ratio summation value (%)) every time an image is formed on a sheet of recording medium.

Figure 17:
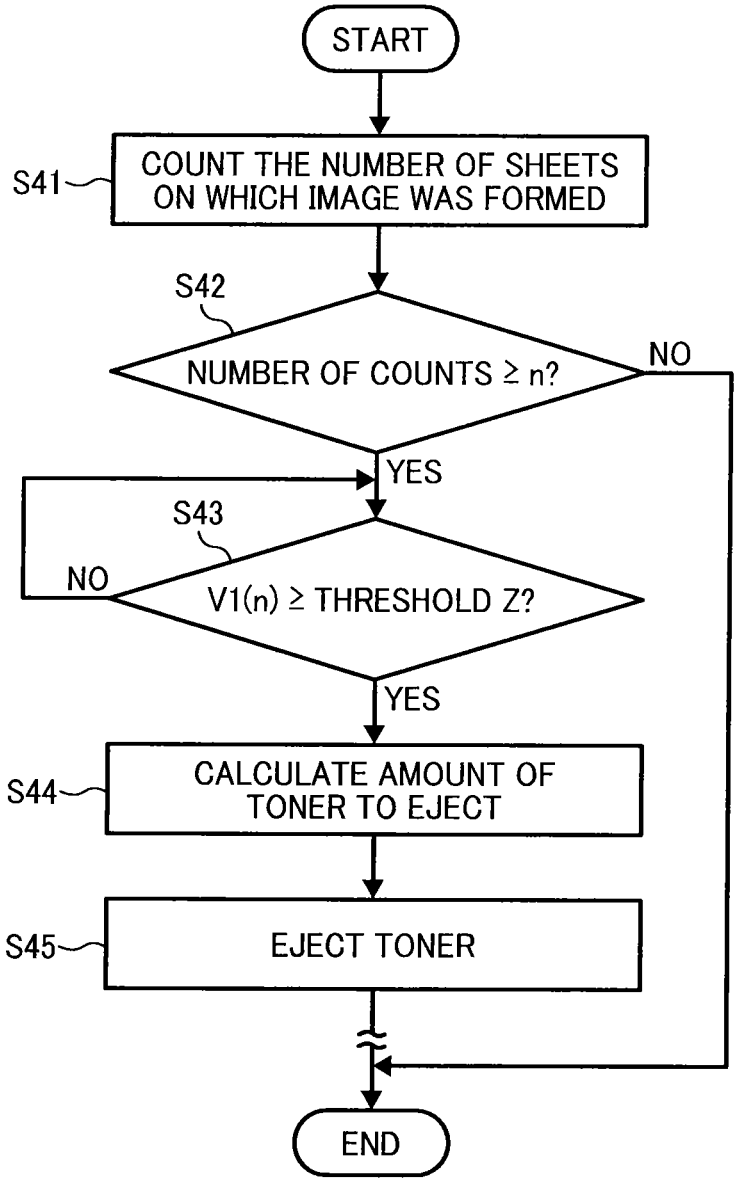
FIG. 17 is a flowchart showing steps in a main control according to Variation 2.

FIG. 17 is a flowchart showing steps in a main control exerted by the controller 200 according to Variation 2. First, at step S41, when the image forming apparatus is activated, the controller 200 counts the number of sheets on which the image has been formed since the previous toner ejection. According to Variation 2, the number of sheets is counted by the operation circuit (CPU) serving as a counter. Subsequently, at step S42, the controller 200 determines whether or not the number of sheets or the count has reached the predetermined number (n) of sheets. If the controller 200 determines that the number of sheets has reached the predetermined number n, the process advances to the next step S43.

At step S43, it is determined whether or not the video count summation value V1(n) exceeds the threshold value Z. If the video count summation value V1(n) exceeds the threshold value Z, the process advances to the next step S44. Similar to V1(n), the same steps are applied to V2(n), V3(n), and V4(n). In Variation 2, the same threshold value Z may be used for V1(n), V2(n), V3(n), and V4(n). Alternatively, the threshold value Z may be differed between V1(n), V2(n), V3(n), and V4(n).

At step S44, the controller 200 calculates an amount of toner to be ejected from the developing devices 5BK, 5Y, 5M, and 5C to the photosensitive drums 1BK, 1Y, 1M, and 1C such that an average image ratio in each of the image forming units 40BK, 40Y, 40M, and 40C coincides with the predetermined values $\alpha 1$, $\alpha 2$, $\alpha 3$, and $\alpha 4$. Then, the process advances to the next step S45.

At step S45, the toner is ejected in accordance with the calculated amount of toner to be ejected. More specifically, the developing devices 5BK, 5Y, 5M, and 5C, the photosensitive drums 1BK, 1Y, 1M, and 1C, and the intermediate transfer belt 11 are driven to rotate. In order to prevent the ejected toner adhered to the intermediate transfer belt 11 from sticking to the secondary transfer roller 36, similar to the adjustment operation shown in FIG. 7, the secondary transfer roller 36 is separated from the intermediate transfer belt 11 before the intermediate transfer belt 11, the developing devices 5BK, 5Y, 5M, and 5C, and the photosensitive drums 1BK, 1Y, 1M, and 1C are rotated at step S45.

According to Variation 2, when rotating the intermediate transfer belt 11 at step S45 shown in FIG. 17, the drive motor 101 is controlled such that the direction of rotation of the rotary shaft 43*a* is opposite that of the moving cam 110. Accordingly, undesirable rotation of the moving cam 110 is prevented reliably, hence preventing a separation error of the secondary transfer roller 36 and the intermediate transfer belt 11, and preventing reliably contamination of the secondary transfer roller 36 upon ejection of the toner.

Figure 14:
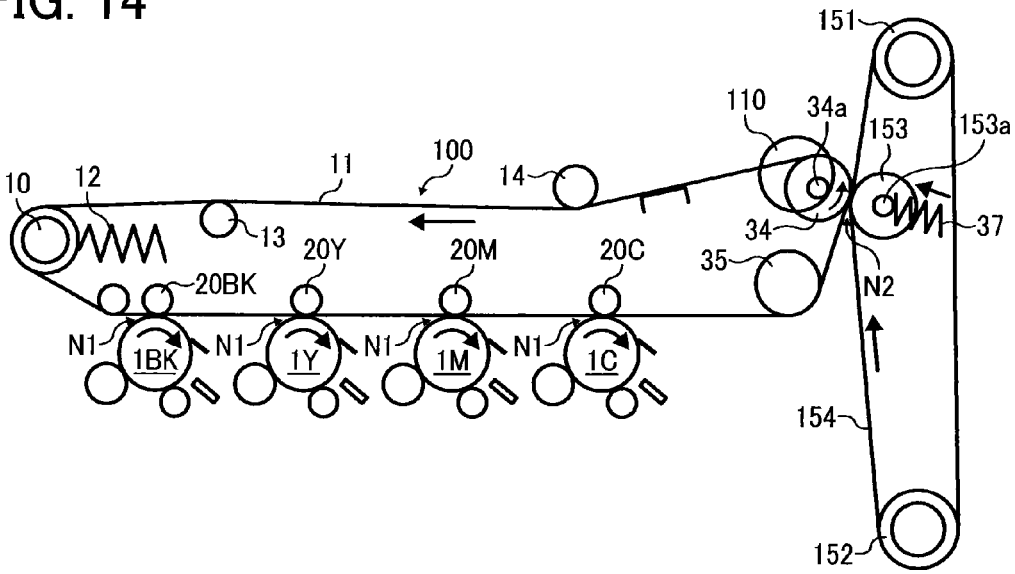
FIG. 14 is a schematic diagram illustrating another example of the nip forming member.

According to the illustrative embodiments described above, a roller-type nip forming member, i.e., the secondary transfer roller 36, is employed as the nip forming member. However, the nip forming member is not limited to a roller. For example, as illustrated in FIG. 14, a belt-type nip forming member may be employed. In FIG. 14, a secondary transfer belt 154 formed into an endless loop serves as a nip forming member. The secondary transfer belt 154 is entrained around a plurality of support rollers 151, 152, and 153. The secondary transfer belt 154 is disposed opposite the support roller 34 with the intermediate transfer belt 11 interposed therebetween.

In the configuration shown in FIG. 14, the support roller 153 serves as the secondary transfer roller. A shaft 153*a* rotatably supporting the support roller 153 is pressed by the spring 37, thereby causing the secondary transfer belt 154 to contact the intermediate transfer belt 11 at a position opposite the support roller 34. The moving cam 110 moves the shaft 154*a* in the contact and the separating directions, thereby moving the secondary transfer belt 154 towards and away from the intermediate transfer belt 11. In this case, the same effects as the foregoing embodiments can be achieved by controlling the drive motors 101 and 105 that drive the moving cam 110 and the intermediate transfer belt 11 by the controller 200.

According to the illustrative embodiments and variations described above, a description is provided of an example of the image forming apparatus using a belt-type image bearing member, i.e., the intermediate transfer belt 11. However, the image bearing member is not limited to a belt, but may be a drum-type. The same effect as that of the foregoing embodiments and variations can be achieved with this configuration using the drum-type intermediate transfer member.

The image forming apparatus is not limited to an image forming apparatus using an intermediate transfer method in which an image is transferred onto a recording medium via an intermediate transfer member. For example, the image forming apparatus may employ a direct transfer method, and the illustrative embodiments and variations may be applied thereto. In the image forming apparatus of this type, the image bearing member is a photosensitive drum, and a transfer member contacts the photosensitive drum to form a nip. An image is directly transferred onto the recording medium from the photosensitive drum at the nip. The same effect as that of the foregoing embodiments and variations can be achieved with this configuration.

According to the illustrative embodiments described above, the first drive source 101 is connected to the rotary shaft 34*a* to drive the rotary shaft 34*a* with the drive force of the drive source 101. Alternatively, the first drive source 101 is connected to a roller (for example, the support roller 10 or 35) that supports the intermediate transfer member as the image bearing member (for example, the intermediate transfer belt 11). Accordingly, the drive force of the drive source 101 rotates the roller, causing the intermediate transfer member to rotate, which then causes the rotary shaft 34*a* to rotate.

Similar to the foregoing embodiments, this configuration may be equipped with the restriction member (i.e., 150 and 200) that inhibits rotation of the moving cam 110 when the nip forming member (for example, the secondary transfer roller 36) is separated from the image bearing member (for example, the intermediate transfer belt 11) due to rotation of the moving cam 110. Accordingly, an separation error of the nip forming member and the intermediate transfer member is prevented.

According to an aspect of this disclosure, the image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a rotary shaft;

a first image bearing member to bear a visible image on a surface thereof, the first image bearing member rotatable about the rotary shaft which is directly or indirectly driven;

a nip forming member to contact the first image bearing member to form a transfer nip therebetween;

a moving device disposed on the rotary shaft, to rotate to move the nip forming member to contact and separate from the first image bearing member; and a restriction member to inhibit rotation of the moving device in a state in which the nip forming member is separated from the first image bearing member by the rotation of the moving device, wherein the restriction member inhibits the rotation of the moving device by pressingly contacting the moving device along the axis of the rotary shaft.

2. The image forming apparatus according to claim 1, wherein the first image bearing member is an intermediate transfer member detachably attachable relative to a main body of the image forming apparatus and entrained around a plurality of rotary members including one that is disposed on the rotary shaft, and wherein the nip forming member disposed opposite the intermediate transfer member is a secondary transfer member, a portion of which contacts the intermediate transfer member.

3. The image forming apparatus according to claim 1, wherein the image bearing member is a belt formed into an endless loop and supported by a plurality of rollers.

4. An image forming apparatus, comprising:

a rotary shaft;

a first image bearing member to bear a visible image on a surface thereof, the first image bearing member rotatable about the rotary shaft which is directly or indirectly driven;

a nip forming member to contact the first image bearing member to form a transfer nip therebetween;

a moving device disposed on the rotary shaft, to rotate to move the nip forming member to contact and separate from the first image bearing member;

a restriction device to inhibit rotation of the moving device in a state in which the nip forming member is separated from the first image bearing member by the rotation of the moving device;

a first drive source to rotate directly or indirectly the rotary shaft;

a second drive source to rotate the moving device; and a drive transmission device to transmit a rotary driving power from the second drive source to the moving device, wherein the restriction device includes a controller operatively connected to the first drive source and the second drive source, and the controller controls the second drive source to rotate the moving device to separate the nip forming member from the first image bearing member, and wherein in a state in which the nip forming member is separated from the first image bearing member, the controller controls the first and the second drive sources such that the rotary shaft and the moving device rotate in opposite directions to each other.

5. The image forming apparatus according to claim 4, wherein the controller controls the first drive source to rotate the rotary shaft in a direction opposite that of the moving device at a time between an adjustment operation performed after a first image forming operation in which a toner image is formed on the first image bearing member, and a second image forming operation in which a toner image is formed on the first image bearing member after the adjustment operation.

6. The image forming apparatus according to claim 5, wherein the controller controls the first drive source to rotate the rotary shaft in a direction opposite the direction of rotation thereof at the first image forming operation.

7. The image forming apparatus according to claim 4, wherein in a case in which the image forming apparatus is stopped for a predetermined time period, the controller rotates the first image bearing member while controlling the first drive source to rotate the rotary shaft in a direction opposite that of the moving device.

8. The image forming apparatus according to claim 4, further comprising:

a second image bearing member to bear a latent image on a surface thereof, the second image bearing member contactable relative to the first image bearing member; and a developing device to develop the latent image formed on the second image bearing member with toner, wherein in a case in which toner is ejected forcibly in the developing device, the controller controls the first drive source to rotate the rotary shaft in the direction opposite that of the moving device.

9. The image forming apparatus according to claim 4, wherein the drive transmission device includes a gear train.

10. The image forming apparatus according to claim 9, wherein the second drive source is disposed in a main body of the image forming apparatus, and the first image bearing member is detachably attachable relative to the main body, and wherein the drive transmission device includes a coupling that connects the second drive source and the gear train as the first image bearing member is installed in the main body.

11. The image forming apparatus according to claim 9, wherein the drive transmission device includes a one-way transmission device that transmits the rotary driving power to the moving device upon inputting the rotary driving power from the second drive source.

12. The image forming apparatus according to claim 1, further comprising a moving body to move the restriction member to pressingly contact and separate from the moving device, wherein the restriction member inhibits the rotation of the moving device by pressingly contacting the moving device in accordance with the movement of the moving body.

13. The image forming apparatus according to claim 12, further comprising a density detector to detect a density of toner on the image bearing member by illuminating the image bearing member with a detection light, wherein the moving body is disposed between the image bearing member and the density detector and includes a shield movable between a first position at which the detection light passes therethrough and a second position at which the detection light is blocked.

14. The image forming apparatus according to claim 13, wherein as the shield moves to the first position, the restriction member pressingly contacts the moving device.

15. The image forming apparatus according to claim 12, wherein a drive source for rotating the moving device coincides with a drive source for moving the moving body.

16. The image forming apparatus according to claim 15, further comprising a drive transmission device to transmit a rotary transmission power from the drive source to the moving device to rotate the moving device, wherein the first image bearing member is an intermediate transfer member detachably attachable relative to a main body of the image forming apparatus and entrained around a plurality of rotary members including one that is disposed on the rotary shaft, and wherein the drive source is disposed in the main body, and the moving device and the moving body are driven by the same drive source via the drive transmission device.

17. An image forming apparatus, comprising:

a rotary shaft;

a belt rotatable by rotation of the rotary shaft;

a nip forming member to contact the belt to form a transfer nip therebetween;

a cam disposed on the rotary shaft, to rotate to move the nip forming member to contact and separate from the belt;

a first motor to rotate directly or indirectly the rotary shaft;

a second motor;

a drive transmission device to transmit a rotary driving power from the second motor to the cam; and a controller, wherein the controller controls the first motor to rotate the rotary shaft in a first direction and controls the second motor to rotate the cam in a second direction opposite to the first direction, and then keeps the nip forming member separated from the belt.

18. The image forming apparatus according to claim 17, wherein the drive transmission device includes a coupling and a gear train, the coupling connects the second motor and the gear train.

19. The image forming apparatus according to claim 18, wherein the gear train includes a first gear connected to the coupling and a last gear disposed on the cam, the rotary driving power from the second motor is transmitted via the first gear and the last gear.

20. The image forming apparatus according to claim 17, further comprising a support roller supported by the rotary shaft, wherein the belt is entrained around the support roller.

21. The image forming apparatus according to claim 17, wherein the cam is an eccentric cam.

22. The image forming apparatus according to claim 17, wherein the controller controls the first motor to rotate the rotary shaft in the second direction to transfer a toner image from the belt to a recording medium in the transfer nip, and then to rotate the rotary shaft in the first direction after transfer of the toner image.

23. The image forming apparatus according to claim 17, wherein the controller keeps the nip forming member separated from the belt until a next image forming operation.

* * * * *